US009027281B2

(12) United States Patent
Shalom

(10) Patent No.: US 9,027,281 B2
(45) Date of Patent: May 12, 2015

(54) SAFETY ENHANCED DESIGN OF RAIL TYPE GARAGE DOOR OPENER WITH OVER THE DOOR DRIVE ASSEMBLY

(71) Applicant: Eddy Shalom, Valencia, CA (US)

(72) Inventor: Eddy Shalom, Valencia, CA (US)

( * ) Notice: Subject to any disclaimer, the term of this patent is extended or adjusted under 35 U.S.C. 154(b) by 0 days.

(21) Appl. No.: 14/046,251

(22) Filed: Oct. 4, 2013

(65) Prior Publication Data

US 2015/0013229 A1 Jan. 15, 2015

Related U.S. Application Data

(63) Continuation-in-part of application No. 13/941,522, filed on Jul. 14, 2013.

(51) Int. Cl.
*E05D 15/38* (2006.01)
*E05F 15/16* (2006.01)

(52) U.S. Cl.
CPC ..... *E05F 15/1607* (2013.01); *E05D 15/38* (2013.01); *E05F 15/1623* (2013.01); *E05F 15/668* (2015.01); *E05F 15/673* (2015.01)

(58) Field of Classification Search
USPC ..... 49/197, 199, 26, 27, 28
See application file for complete search history.

(56) References Cited

U.S. PATENT DOCUMENTS

| | | | | | |
|---|---|---|---|---|---|
| 2,056,174 | A * | 10/1936 | Earhuff et al. | ..... | 318/266 |
| 2,822,166 | A * | 2/1958 | Herbert | ..... | 49/199 |
| 2,883,182 | A * | 4/1959 | Bornemann | ..... | 74/89.23 |
| 2,944,810 | A * | 7/1960 | Stuettig et al. | ..... | 49/28 |
| 3,076,935 | A * | 2/1963 | Jones | ..... | 341/176 |
| 3,084,318 | A * | 4/1963 | Lind | ..... | 318/266 |
| 3,397,488 | A * | 8/1968 | Goldstein | ..... | 49/199 |
| 3,478,469 | A * | 11/1969 | Estes | ..... | 49/199 |
| 3,481,074 | A * | 12/1969 | Moss | ..... | 49/28 |
| 4,274,227 | A * | 6/1981 | Toenjes | ..... | 49/28 |
| 5,544,691 | A * | 8/1996 | Wandio | ..... | 160/188 |
| 6,184,641 | B1 * | 2/2001 | Crimmins et al. | ..... | 318/466 |
| 7,862,209 | B2 * | 1/2011 | Fitzgibbon et al. | ..... | 362/294 |
| 8,464,468 | B2 * | 6/2013 | Sommer et al. | ..... | 49/358 |
| 2006/0289129 | A1 * | 12/2006 | Mullet et al. | ..... | 160/201 |

* cited by examiner

*Primary Examiner* — Katherine Mitchell
*Assistant Examiner* — Catherine A Kelly

(57) ABSTRACT

A novel electric door opener for a garage, or equivalent structure, which uses a rail fixed at one end to a drive assembly and the other end to a mounting support, in which the drive assembly is mounted on the wall over the garage doorway with a pivotable mount, rather than the uniform practice wherein the drive assembly is suspended from the garage ceiling, thus significantly enhancing safety during installation and over the lifetime of the unit. In addition, the means whereby prior art rail type garage door openers, including their drive assemblies and overall mounting methods, are redesigned to reduce the invention to practice. The simplification of mounting hardware and process with this design makes it much easier and safer to install, remove, and replace an assembled rail type garage door opener, using only three removable pins.

10 Claims, 13 Drawing Sheets

SAFETY ENHANCED DESIGN OF RAIL TYPE GARAGE DOOR OPENER WITH OVER THE DOOR DRIVE ASSEMBLY

This is a Continuation-In-Part of application Ser. No. 13/941,522, filed on Jul. 14, 2013 for "Method and Apparatus for Mounting a Garage Door Opener."

BACKGROUND OF THE INVENTION

The present invention relates to a novel design and architecture for an electric door opener of the "rail type" (as defined below) for a garage or equivalent structure, in which a novel "drive assembly" (as defined below) is mounted in an advantageous position over the garage door opening with a pivotable mount, with no impact to functionality or performance, while providing a significant enhancement to safety, both during installation as well as over the lifetime of the unit. By contrast, drive assemblies for rail type garage door openers uniformly prevalent in the marketplace are required to be suspended from (or otherwise mounted to) the garage ceiling.

In addition to a novel structural design and architecture for rail type garage door openers, the present invention provides novel designs for a number of means that constitute changes to the drive assembly itself, and/or novel changes to the apparatus used for mounting, in order to reduce the invention to practice. All design changes to the drive assembly are supported by the design of appropriate mounts and mechanical adapters. None of these changes requires a complete redesign of the fundamental supporting components of prior art drive assemblies, such as the electronics, the drive train, the rail and trolley system, the safety features, and so on.

While the primary advantage of the present invention is that it can promote public safety, as a collateral advantage it is much easier and simpler to install and/or remove, such that either process is based upon the use of only three removable pins. (Two of the three removable pins are co-linear, and in theory could be combined into a long, single pin. Although this approach would technically result in a "two pin" solution, it was deemed to be impractical, and a trivial exception to "three pin" solution.) Either approach is a significant contrast to the prior art, in which the installation, removal and replacement of a rail type garage door opener is both laborious and risky.

It has been almost 90 years since the invention of the electric rail type garage door opener. Since then, perhaps hundreds of models of rail type garage door openers have been designed and marketed. It is estimated that many tens of millions of prior art units have been sold and installed, and that over a billion people around the world currently live and/or work in locations with prior art units. On the order of 200 patents have been granted regarding improvements to rail type garage door openers. In spite of many significant incremental improvements, no invention has heretofore challenged the basic structural architecture of the prior art, in spite of its significant deficiencies from a safety standpoint.

As will be seen, the invention disclosed herein is by no means "a trivial rearrangement of existing parts that does not produce new and unexpected results". In fact, given the long history of rail type garage door openers, the enormous size of the present day market, and the severe deficiencies in heritage designs, it is completely unexpected that with modest changes to the prior art, the completely novel design and architecture of the invention disclosed herein allows it to be installed in a much easier and safer manner than the prior art, to operate seamlessly with respect to all required garage door opener functions, and provide significant safety enhancements that can benefit many millions of people.

Definition of "Rail Type" Garage Door Opener and "Drive Assembly" Thereof

"Rail type" electric rail garage door openers are well known in the art. Rail type garage door openers use a "drive assembly" which is suspended from the ceiling somewhere near the middle of the garage. As used herein, the term "drive assembly" for a rail type garage door opener refers to the unit which contains the drive motor, gears, electronics, lights, and so on, as well as associated structure and apparatus for mounting. The inclusion of structure and mounting apparatus in this definition of the drive assembly is required to avoid ambiguity regarding the scope of the various embodiments of drive assemblies to be presented herein. For example, some of these embodiments depict structure that can be made integral with the drive assembly chassis, or alternatively incorporated into a physically separate apparatus used for mounting. Such alternatives are considered to be inconsequential variants of the novel configuration of garage door openers and drive assemblies to be disclosed herein, as will be clear to one skilled in the art. The drive assembly has a rail fixed to its proximal end, while the distal end of the rail is attached to a bracket which is mounted above the garage door opening. The drive assembly drives a moveable fixture, called a "trolley", along the rail by means, typically including, inter alia, a chain, belt, or screw drive mechanism. Typically, one end of the J-arm is attached to the trolley, and the other end to a bracket near the top of the garage door. In operation, the electric motor in the drive assembly for a rail type garage door opener moves the trolley along the rail, which subsequently opens or closes the garage door via the J-arm.

In assessing the state of the art regarding rail type garage door openers, it is helpful to review the classes of garage doors, the classes of electric garage door openers, and the capability of each class of garage door opener versus the garage door classes.

Classes of Garage Doors

In discussing classes of garage doors, it is important to note that in order to reduce the force needed to move the door, all garage door classes either employ springs or weights suspended on cables to counterbalance the weight of the door. The garage doors themselves are essentially either a "one piece" or sectional. One piece garage doors either have a pair of tracks or a pair of levered hinges on either side of the door to constrain the movement of the door. One piece garage doors with tracks employ either a torsion spring over the garage door opening or a pair of extension springs on either side, while one piece doors with levered hinges have springs integral to the hinges. Sectional garage doors require a pair of tracks to constrain the motion of the door, and employ either a torsion spring over the garage door opening or a pair of extension springs on either side.

Classes of Garage Door Openers

There are essentially three classes of prior art garage door openers; the rail type class, a "jackshaft" drive class, and a "direct drive" class. As has been defined herein, the rail type class uniformly has a drive assembly suspended from the garage door ceiling in a fixed position.

As the name implies, the jackshaft drive class controls the position of the garage door by rotating a torsion bar (i.e., jackshaft), which is located above the garage door opening, extending beyond it on either side. The drive assembly for this class is mounted at one end of the torsion bar, on the wall beside the garage door opening. The motor in the drive assembly rotates the torsion bar, which drives pulleys and cables that lift the garage door.

The "direct drive" class of garage door opener is the most recent, and has a drive unit that comprises a drive motor and a sliding structure, such that the drive unit moves in either direction along the length of a rail. As currently constituted, this class also has an electrical control unit suspended from the ceiling of the garage, which supports ancillary functions, and provides DC power to the moving drive unit via a power strip in the rail. Because of this unique configuration, even though it has a rail, this class of garage door opener is not been included in the "rail type" classification, which is reserved herein for traditional rail applications, which have a fixed drive assembly.

Observations on the Classes of Garage Door Openers and their Applicability

Based upon the above, a key observation is that none of the prior art garage door openers have a drive assembly mounted on the wall over the garage door opening with a pivotable mount, as does the present invention. All of the prior art garage door openers prevalent in the marketplace, with the exception of the jackshaft class, have some type of electrical unit suspended from the garage door ceiling, unlike the present invention.

Regarding the applicability of the prior classes of garage door openers, all of them can be used with all classes of garage doors, with the exception of the jackshaft class, which is clearly limited to sectional doors with torsion bars. As will be seen, the present invention can not only be used with all classes of garage doors, but can do so while supporting all secondary functions.

Prior Art of Garage Door Openers of the Rail Type

In order to make a fair assessment of the novelty, utility, and non-obviousness of the present invention vs. the prior art, it is appropriate to briefly survey key inventions regarding electric garage door openers of the rail type, starting with the first electric garage door opener in U.S. Pat. No. 1,578,177, "Garage Door Opening Device" which was issued to Andrew Schrade and Elmer Johnson in 1926. This patent was for a rail type garage door opener with a chain drive, and had a drive assembly suspended from the garage ceiling. In effect, this patent used the prior art knowledge of using a rotary electric motor with a sprocket to drive a chain, and combined this mechanism with linkage to the garage door.

A second key patent is U.S. Pat. No. 2,637,550, "Overhead Door Actuator, issued to B. Ritter in 1953, which was for a rail type garage door opener with a screw drive, which also had a drive assembly suspended from the garage ceiling. Instead of using a chain, it combined an extended screw and travelling nut, a well established mechanism at the time, with the prior art.

A third patent of interest is U.S. Pat. No. 5,010,688, "Garage Door Operator with Plastic Drive Belt", issued to Kenneth J. Dumbrowski, et. al., in 1991, which was for a rail type garage door opener with a belt drive, which also had a drive assembly suspended from the garage ceiling. As a replacement for a metal chain, this invention combined a toothed belt made of a compliant material to transmit force, at the time a very well established practice in automobiles and elsewhere, with the prior art.

The three patents above were are cited because they are the most salient inventions regarding the physical plant of prior art garage door openers, and in fact the chain, screw, and belt drive mechanisms are the predominant embodiments in the current marketplace. From an objective standpoint, since it is clear that all of the above patents were novel and useful, they should be very helpful in providing a gauge for the more subjective question of obviousness for the present invention. Both of the two follow-on patents described above focused on incremental improvements in the "drive chain", while combining existing elements in a novel way, but neither of them challenged the fundamental architecture of the traditional rail based garage door opener that was established by the first patent cited. When considered in this regard, it should be clear that if the substitution of a toothed plastic belt to transmit linear force instead of a metal chain in 1991 is deemed to have yielded "new and unexpected" results, it is logical that the results of the invention disclosed herein should be deemed far more novel and unexpected.

Because of numerous accidents and injuries resulting from the operation of rail type garage door openers, a number of inventions have led to such standard features as the ability to sense excessive resistive force (from a person or inanimate object) and reverse direction, the ability to sense obstacles and prevent actuation, and so on. However, the basic architecture of rail type garage door openers prevalent in the marketplace, with the drive assembly suspended from the ceiling, has not changed since the 1920's, and the dangers inherent in this architecture, during installation and subsequently, have persisted to this day.

Deficiencies in Design and Installation Method of Prior Art Garage Door Openers In the typical installation of a rail type garage door opener uniformly prevalent in the marketplace, the end of the rail which is distal from the drive assembly is first attached to a mounting bracket, located on the wall above the garage door (for clarity, any references to "above the garage door" herein assume the door is closed), while the drive assembly at the proximal end of the rail rests upon the garage floor. The drive assembly, connected to the proximal end of the rail, must then be lifted and supported in a position whereby it can be mounted to the garage ceiling, which is typically at least eight feet above the floor. The temporary support for the drive assembly and rail during this generally custom installation, typically at a height of seven feet or more, is often provided by having a ladder, as well as an assistant.

The above-door mounting bracket for the distal end of the rail is typically an included part when one purchases a new rail type garage door opener, and usually no additional hardware is required to mount this end. Some rail type garage door openers do provide a minimal hardware kit, such as hanging straps and a L-bracket, for mounting the drive assembly end, but it is generally the responsibility of the installer to fabricate a bracket or similar structure to suspend the relatively heavy drive assembly from the ceiling. Given the mass of the drive assembly, and the need to provide it with temporary support during installation, the task of mounting it under these conditions in a secure manner to the garage ceiling is usually the most risky and challenging part of the installation. Therefore, it stands to reason that the majority of accidents, to both property and personnel, occur during this installation stage of prior art garage door openers.

As noted above, since a custom mounting bracket may be required for holding the drive assembly in the proper position, whereby it hangs at the correct height from the garage ceiling, the "engineering" associated with such installations is by no means uniform. As there is no real uniformity in mounting the drive assemblies to the garage ceiling, it is readily apparent that the robustness of the mountings vary considerably, with some mounts being much inferior to others. As will be discussed in more detail herein, there is generally a complete absence of building and safety codes at either the state or federal level governing the adequacy of garage door opener installation.

This leads to an inherent problem with such typical rail type garage door opener installations, particularly when the rail type garage door opener is purchased and installed by an inexperienced homeowner, which is often the case. These dangers are highlighted by the typical installation instructions provided with rail type garage door openers, which warn in general terms that the incorrect installation or operation of such units can lead to serious injury and/or death, but do not provide any specifics in terms of safety factors, or other objective criteria, for a safe and secure installation.

In particular, while some drive assemblies will be securely mounted by a well engineered system of angle iron or similar material, properly secured to the ceiling joists, along with appropriate bracing to insure that the drive assembly is secure, other installations may not be at all securely mounted, whereby they are subject to vibration. This is a particular problem in those areas which are subject to earthquakes or windstorms, as the resulting shaking and vibration can cause drive assemblies to fall from the ceiling, damaging autos or injuring persons below them.

Absence of Guidance Regarding Garage Door Opener Installation

Since state and/or federal building and safety codes in the United States regarding the safe and secure structural installation of garage door openers do not exist, there are presently many deficient installations. The installation instructions provided with garage door openers often only provide general guidance, rather than specifics. As a result, many installations may be adequate in terms of a safety margin for the static loading of the mass of the rail type garage door opener, but do not take into account even nominal dynamic loading and vibration effects, exclusive of windstorms and earthquakes, over the lifetime of the unit. In particular, many drive assemblies are hung from garage ceilings using screws driven vertically into the ceiling joists. The vibration and swaying caused by the suspended drive motor can cause such screws to loosen over time. Due to their vertical orientation, such screws are prone to being pulled from the joists, with the result that the drive assembly and attached rail fall to the ground (or whatever else is beneath them).

The peril described in the foregoing scenario is exacerbated by the fact that for garages with finished ceilings, the actual position of the joists is not visible. Installations in such garages typically include the use of stud finders and/or making a series of small holes in the ceiling to try to identify the center of the joists hidden above the dry wall. As the joists are typically only about 1.5 inches wide this procedure is imprecise, possibly resulting in the installation of the screws significantly off-center, whereby the actual load bearing capability of the suspended mount may be severely compromised, even though the drive assembly may appear externally to be securely mounted.

A further complication results when the garage ceiling is higher than normal, so that the drive motor needs to be suspended at a greater distance from the ceiling than is normally required. Some experienced installers may recognize that this situation requires cross-bracing on the drive assembly suspension members to reduce vibration and swaying of the drive assembly during operation, as such movement and vibration can cause the mounting screws to loosen. As a rule, most installation instructions for garage door openers do not even address this issue. As a result, in many cases this reinforcement is not done, since the installation visually appears to be adequate under static load conditions.

Contrast with Guidance for Installation of Water Heaters

The situation regarding the perils implicit in the prior art design of rail type garage door openers can be contrasted with public awareness of the dangers of unsecured water heaters, many of which are installed in garages. Guidelines for seismic safety at both the state and federal level encourage property owners to install simple and inexpensive hardware kits to prevent water heaters from falling during storms and earthquakes. While there is an extra risk regarding gas powered water heaters, as they are likely to sever their gas lines if they fall, the use of such kits is recommended for all water heaters, including those powered by electricity.

For consistency, there is a strong argument that seismic safety awareness should also extend to the suspension of heavy masses from a garage ceiling. At the present time, the fact is that relatively heavy masses are suspended from garage ceilings in hundreds of millions of homes throughout the United States and the world, without clear safety standards. Building and safety codes don't allow such a uncontrolled situation to exist in the "living space" within these homes, even though an individual may be as apt to be in a garage as in a dining room that has a heavy chandelier suspended overhead.

Regarding this issue, on May 20, 2013 the present inventor received the following message from Mr. Richard McCarthy, Executive Director of the California Seismic Safety Commission: "Thank you for your recommendation regarding the bracing of overhead garage door openers and the Commission's "Homeowners Guide to Earthquake Safety." As you are aware, State Government has experienced budget reductions and furloughs for almost 5 years now. Many valuable projects have not been completed or have been eliminated because of these difficult financial times. As of today, the Governor's office and the legislature are working together to find a new and permanent funding source for the Commission (effective July 1). Should a permanent funding source be identified, then the Commission will examine its budget and begin to identify and prioritize projects to revisit. The Homeowner's Guide is certainly a product I would like to update. I will keep your suggestion regarding overhead garage door openers and make sure it is considered when the Commission decides to update the Guide."

Contrast with Mandated Safety Requirements for Garage Door Opener Operation

An area regarding the safe operation of garage door openers that has been addressed involves a set of features that makers of garage door openers are required to install in their products, with the goals of preventing entrapment of people under the garage door and preventing associated injuries from the movement of the door. These measures were driven by a number of fatal accidents, primarily to children: for example, it is estimated that 3 to 4 children died annually from garage door opener accidents between and 1974 and 1995. These measures have been mandated and periodically updated by the U.S. Consumer Product Safety Commission (CPSC). A number of these measures are informally described below as part of the disclosure of the present invention, but clearly the governing statement of these requirements are those of the CPSC.

In general, when there is a clear and present danger to life and limb, it is troubling to discover that budgetary restrictions, such as those of the State of California described above, may prevent or delay even modest efforts to mitigate the danger. For this reason, a report describing the generic safety concern regarding rail type garage door openers has been sent to the CPSC, and is currently being processed. It seems logical that if the CPSC's mandate gives it the latitude to require makers of garage door openers to install safety features relating to the operation of these units, that it should at least address the means to promote safety in the installation of these prior art products.

These means can be as simple and inexpensive as requiring makers of garage door openers to provide some guidelines to the end user regarding safe installation. As an example, the installation instructions for a prior art unit could specify that for a particular model the mass suspended from the ceiling will be 30 pounds, and that the mount needs to have a safety margin of 3. In addition, the instructions could specify that if the drive assembly is suspended more than 2 feet from the ceiling, the safety margin should be 4, and a cross brace should be provided between the metal straps to prevent dynamic forces from weakening the ceiling attachment.

Compared to the commercial impact of the operational safety features, the impact to industry of complying with guidelines similar to those suggested above is trivial. While the value of saving a handful of lives per year completely justifies the current set of operational requirements, there is no doubt that sooner or later a major seismic event or windstorm will occur that will impact millions of people, whereby the benefit of these additional safety measures will justify the very modest investment they require.

In this context, the present invention can spur the appropriate state and federal agencies to take action in two ways. The first way is by encouraging safety inspections by homeowners of all existing garage door installations, with reinforcement or replacement when they are deficient. The second way is to in fact encourage consumers to utilize devices conforming to the present invention whenever it is practical, especially for new installations.

Promotion of Public Safety by Present Invention

In summary, given the above factors, the invention disclosed herein can help promote public interest and awareness in encouraging updates to the guidelines and/or mandates for seismic safety at the state and federal level, while simultaneously helping to mitigate the problem. Such changes can help extend this awareness beyond individual consumers to the public at large. In the event of severe earthquakes or storms which can impact millions of citizens, the benefits of such changes in helping to reduce damage to persons and property should be significant.

In view of the foregoing, it becomes clear from a safety standpoint that the architecture and structural design of prior art of drive assemblies for rail type garage door openers is far from ideal, and has been so for almost a century. The invention disclosed herein provides a novel structural design and architecture for a rail type garage door opener that addresses the multiple deficiencies of the prior art discussed above. As such, it will be seen that the invention to be disclosed herein is not only novel, useful, and non-obvious, but is in fact sorely needed.

SUMMARY OF THE INVENTION

The present invention is a novel rail type garage door opener that provides an entirely novel structural design and architecture, wherein the drive assembly is mounted over the garage door opening with a pivotable mount, which is not found in any form in the prior art, and provides multiple means for reducing the invention to practice. The invention is based upon multiple factors, including the realization that an improved and/or adapted drive assembly for a rail type garage door opener will fit in the new location in virtually all installations, that it can be designed to function in the new location without any changes to the fundamental operation and ancillary functions that have been provided by prior art drive assemblies, and that it will provide significant safety enhancements, as well as other advantages, versus the prior art.

Means Provided by the Invention

In addition, the present invention provides the means whereby prior art drive assemblies and their mounting apparatus can be redesigned in order to support both installation and operation in the location over the garage doorway, doing so with minimal changes to prior art garage door openers. These means are based upon novel changes to the drive assembly itself, and/or novel changes to the method and apparatus used for mounting it. As a result, the installation of the entire garage door opening system is not only easier and safer, but should be much more secure over the lifetime of the unit, greatly reducing the risk to persons and property subsequent to installation.

The use of the terminology such as "doing so with minimal changes to prior art garage door openers" should not be misunderstood. It should not imply that such changes are trivial. For example, a building may require a new foundation for earthquake safety vs. the prior art structure, and the goal of the project should be to "do so with minimal changes to the existing foundation". The attempt throughout this application to reduce as much as possible the impact to the designs of prior art garage door openers is driven by the simple logic that this should make it more attractive for existing suppliers to adopt this invention, and produce it at a low cost. Hopefully, this can lead to a wider use of this invention, and to an improvement in public safety.

It should be understood that the numerous means and variations presented herein to support the present invention, while specific and detailed, are representative approaches, and that those skilled in the art will easily discover many variations that are bounded by the designs disclosed herein. While this invention attempts to provide the most efficient means by which prior art garage door openers can take advantage of a new architecture and geometry, it cannot address all the variations in the state-of-the-art for rail type garage door openers. For example, as a rule the rail is above the drive assembly for openers that employ chains and belts, while for openers that employ a screw drive the rail may be positioned between the top and bottom of the drive assembly. Those skilled in the art will recognize that these minor differences in the geometry of prior art garage door openers are easily addressed within the scope of this invention.

The same observation applies to the pivotable mount for the drive assembly in the present invention, which addresses embodiments in which the axis of rotation of the pivotable mount is essentially under or over the drive assembly, since these are the most practical configurations. To those skilled in the art, an embodiment of the present invention in which the vertical position of the axis of rotation of the pivotable mount was somewhere in the middle of the drive assembly would be an obvious variation. In conclusion, all the degrees of freedom for both the location of the rail as well as the location of the axis of rotation are addressed by the present invention.

While there are numerous references herein to "garage door", it should be understood that the present invention is intended to apply not only to garage doors that open overhead, but applies as well to all classes of overhead opening doors, including hangars, utility buildings, storage buildings, and so on.

Primary and Secondary Advantages of Invention Vs Suspension Mounts

A consequence of the novel design for a garage door opener of this invention is that it eliminates the need for the well known and accepted approach of positioning and mounting the relatively heavy drive assembly in the prior art. While making the installation process much easier and safer is of great value, it is the secondary advantage of this invention. The primary, and most significant advantage of this new design extends past the installation phase, by a significant enhancement of safety for persons and property over the lifetime of the unit.

Installation Advantages of Present Invention Vs Suspension Mounts

The prior art installation of the drive assembly often required the design, engineering, and fabrication of a custom mounting bracket structure by the installer, followed by an installation process that was not only awkward, but which could be perilous. By contrast, this invention enables the replacement of the prior art architecture and process with a secure, standard, well designed mounting installation over the garage door opening that does not require ad hoc hardware or design, and which is far safer to implement.

In order to reduce the present invention to practice, an number of above-the-door mounts are disclosed by the present invention, such that the pivotable mount for the drive assembly (with a range of adaptations and redesign) can be securely attached to the wall of the garage, above the garage door opening, whereby it will typically be screwed into the studs and/or header which are part of the structure which supports the wall of the garage, rather than using the traditional ceiling mounted bracket system, unique to each installation as in the prior art.

In general, the header spanning the garage door opening is a relatively massive beam many inches in width, whereby it provides an inherently secure base for installation. However, with either studs and/or header, with the present invention the mass of the drive assembly is generally supported by screws inserted horizontally, so that the forces on the screws are generally perpendicular to their orientation. As such, the installation of the drive assembly in accordance with the present invention is intrinsically superior to a suspended mount where the supporting screws are generally inserted vertically. In addition, installations in accordance with the present invention provide a substantially rigid framework, as compared to a flexible suspended mount, thereby providing superior resistance to both static and dynamic forces.

In accordance with the present invention, the relatively heavy drive assembly is mounted securely to the wall of the garage, while only the relatively lightweight distal end of the rail needs to be mounted to the ceiling of the garage. Since the entire mass of the drive assembly is substantially supported at the proximal end of the rail, and the rail is essentially a uniform structure, only about one half of the mass of the rail is suspended from the ceiling at the distal end of the rail. By contrast, in the prior art, the mass suspended from the ceiling is essentially the entire drive assembly plus about one half the mass of the rail.

Advantages of Present Invention for Replacement and Noise Suppression Vs. Traditional Suspension Mounts A further advantage of the means provided by this invention is that it provides options whereby the intrinsic mount of the drive assembly allows it to be held in place with only two removable pins. Since the traditional anchoring of the distal end of the rail with a single removable pin can be retained by the present invention, the end result is that an assembled rail type garage door opener can be removed, repaired, and replaced with only three removable pins. This is a great advantage when compared with the equivalent process for the prior art.

In addition, since the suspension of the distal end of the rail is substantially insulated from the mechanical vibration of the motor drive (being at the opposite end of the rail) it does not need much accommodation for dynamic forces during operation. As such, even for garages with high ceilings the suspension of the distal end is much simplified with this invention, as the mounting for the distal end of the rail must largely only accommodate static forces, regardless of the height of the ceiling.

A number of attempts have been made in the past to mitigate the vibration and noise created by rail type garage door openers by independent inventors, who typically sell rubber bushings and components that can be applied to the drive assembly suspension mount at various locations. As is clear to those skilled in the art, it is very difficult to insert such pliant means into a load bearing suspension mount; for example, one cannot use a thick rubber member for direct support without some structure to support the load if the rubber part fails. It seems likely that since these measures can introduce risk and/or have limited benefits for suspension mounts, they have not been embraced by garage door makers.

The nature of the garage door opener design in the present invention facilitates the safe use of pliant components for reduction of vibration and noise, and may lead the actual makers of rail type garage door openers to incorporate these parts into their products. Users will feel more comfortable using these measures if they are certified and underwritten by garage door manufacturers.

Summary of Advantages

In summary, the design of the garage door opener in this invention has enabled a much more safe, stable, robust, and uniform system for installation. Beyond this, however, the design of the rail type garage door opener of this invention significantly mitigates an unnecessary risk over the lifetime of rail type garage door openers uniformly prevalent in the marketplace, which is inherent in the practice of suspending heavy masses over the heads of hundreds of millions of people without appropriate safety standards and guidelines. Garages should not be excluded from safety considerations that apply to homes: from a safety perspective, they are legitimately extensions of "living spaces".

As a result of these safety enhancement features, garage door openers conforming to this invention are expected to be recommended by future seismic safety guidelines at the state and federal level, and as such, are likely to prevent damage to property and persons in the event of windstorms and seismic disturbances that can impact millions of people. Because the advantages provided by the present invention can clearly promote safety, it is believed that the public interest requires that measures be taken as soon as possible to make these benefits tangible, as there are no good means to predict when a catastrophe such as a major earthquake will strike a heavily populated area. What is certain, unfortunately, is that sooner or later such events are bound to occur.

DETAILED DESCRIPTION OF THE PREFERRED EMBODIMENTS

Prior Art Garage Door Opener with Suspended Drive Assembly

Figure 1:
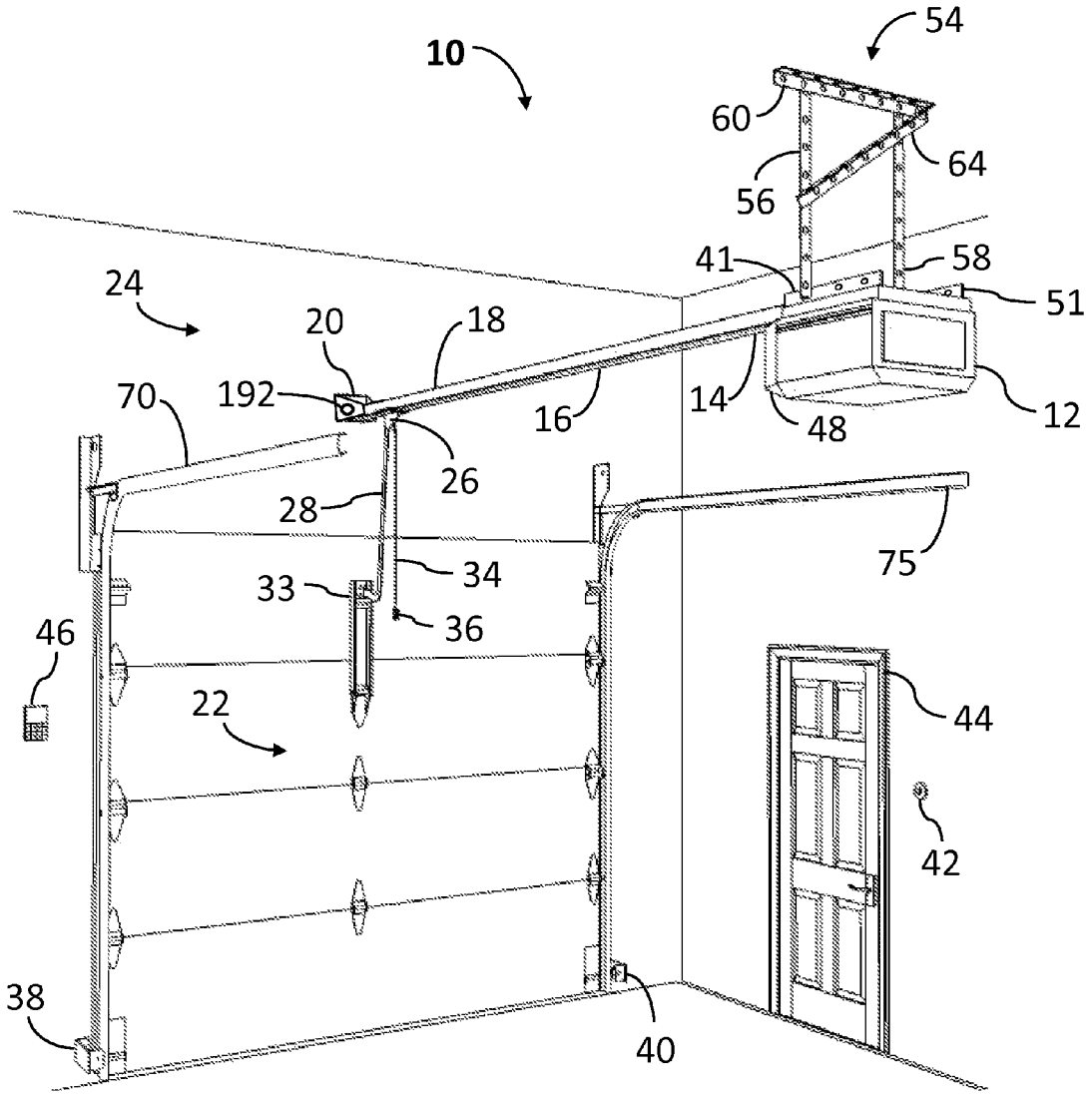
FIG. 1 (Prior Art)
FIG. 1 (Embodiment 10) is a perspective view of a prior art rail type garage door opener with a ceiling suspension mount.

Referring to FIG. 1 (Prior Art), a rail type garage door opener 10 of the type known in the prior art to which the present invention relates is shown. The rail type garage door opener 10 is comprised of a drive assembly 12 to which the proximal end 14 of a rail 16 is attached. The distal end 18 of the rail 16 is attached to a rail bracket 20 mounted above the garage door 22 which is to be opened and closed. In accordance with the prior art, the rail bracket 20 is affixed, directly or indirectly, to studs or a header on the wall 24 above the garage door 22, and is secured to the distal end 18 of the rail 16 by means of a removable pin 192.

In this representative depiction of a rail type garage door opener, the garage door 22 is sectional, and its movement is constrained by the tracks 70 and 75, which are normally suspended (not shown) from the garage ceiling; however, the basic geometry of the prior art rail type garage door opener in FIG. 1 and its operation, as described below, apply essentially to all garage door classes (as will be described herein).

A trolley 26 can traverse along the rail 16. The movement of the trolley 26 is controlled by the drive assembly 12, using any of several available, known rail type drive mechanisms (including, inter alia, screw drive, chain drive, and belt type drive systems). The trolley 26 is attached to a J-arm 28, which in turn is connected to the upper portion of the garage door 22 via a door bracket 33. In accordance with the prior art, the trolley 26 can be disengaged from the drive mechanism associated with the rail mounted drive system using a latch integral to the trolley 26, which can be used to disengage the trolley 26 from the drive mechanism associated with the rail based system by means of a pull cord 34 which is attached, at one end, to the latch, and hangs down to a pull knob 36 which is used should there be a situation, i.e., a power outage, which requires manual operation of the garage door 22 when the drive assembly 12 is not functioning, or power has been lost.

As is also known to those skilled in the art, typical rail type garage door openers 10 also include an "electric eye" safety system including a transmitter 38 and a receiver 40 which act as safety devices to prevent the closing of the garage door 22 when its path is obstructed, i.e., by a person, vehicle, or other object. A typical rail type garage door opener installation also includes a wall mounted button 42, typically mounted adjacent to an interior door 44 between the garage and the house, and it may also include as well a hard-wired and/or a radio control unit 46 inside the garage, as well as outside the garage. All of these sources, together with remotes in automobiles, are used to control the movement of the garage door 22 by activating the drive assembly 12. A typical drive assembly 12 also includes a light 48 (or several) used to illuminate the garage for a period of time following activation of the drive assembly 12, although some garage door openers also allow the illumination to be controlled independently of the garage door.

A key component of the prior art of drive assemblies are "tabs", which are mounting surfaces that project upwards from the drive assembly 12, such as the pair of parallel prior art mounting tabs 41, 51 affixed to the top of the case of the drive assembly 12 (some models have a single tab on the top of the case). Whether there are a pair of such tabs, or a single one, they are used to suspend the drive assembly from the ceiling of the garage. A particular problem with the prior art garage door opener 10 which is addressed by the present invention is that it is up to the installer (or homeowner) to engineer and assemble a drive assembly mounting system 54 which is used to mount the drive assembly 12 to the ceiling of the garage.

As will be understood by those skilled in the art, the drive assembly mounting system 54 is critical to the safe installation and operation of the rail type garage door opener 10, yet the installer (or homeowner) is generally left on his own to design and build the drive assembly mounting system 54.

Accordingly, it is typical for such a system to include at least a pair of metal straps 56, 58, which are suspended from "something" above. Ideally, the metal straps 56, 58 are securely mounted to either ceiling joists or a rafter or to a piece of angle iron 60 attached to the ceiling joists, i.e., by using lag bolts. In the installation of a typical drive assembly 12 the way that the metal straps 56, 58 and the angle iron 60 are secured is critical to the security of the mounting of the drive assembly unit 12, and hence the entire garage door opening system.

In addition, many who install rail type garage door openers are simply not familiar with the mechanics of such installations. By way of example, they may simply rely upon the use of the metal straps 56 and 58, without any thought of adding some type of diagonal strap 64 to prevent the drive assembly unit from "racking" in a side-to-side manner, which is prone to happen when the length of the metal straps 56 and 58 is excessive, and which can weaken the attachment of the angle iron 60 to the ceiling. Others may even think that providing secure mountings to joists or rafters is unnecessary. While such inadequate methods for attaching the drive assembly 12 to the garage ceiling are well known, and while their consequences, including having the drive assembly 12 fall, have been documented, the drive assembly mounting system 54, and variants thereof, remain an intrinsic and universal component of rail type garage door openers of the prior art. The design of the mounting system 54 and variants thereof are clearly driven by the prior art structural design and architecture of the rail type garage door opener 10, and as such they are an inseparable component of the prior art for rail type garage door openers.

Generic Embodiment of Present Invention

Figure 2:
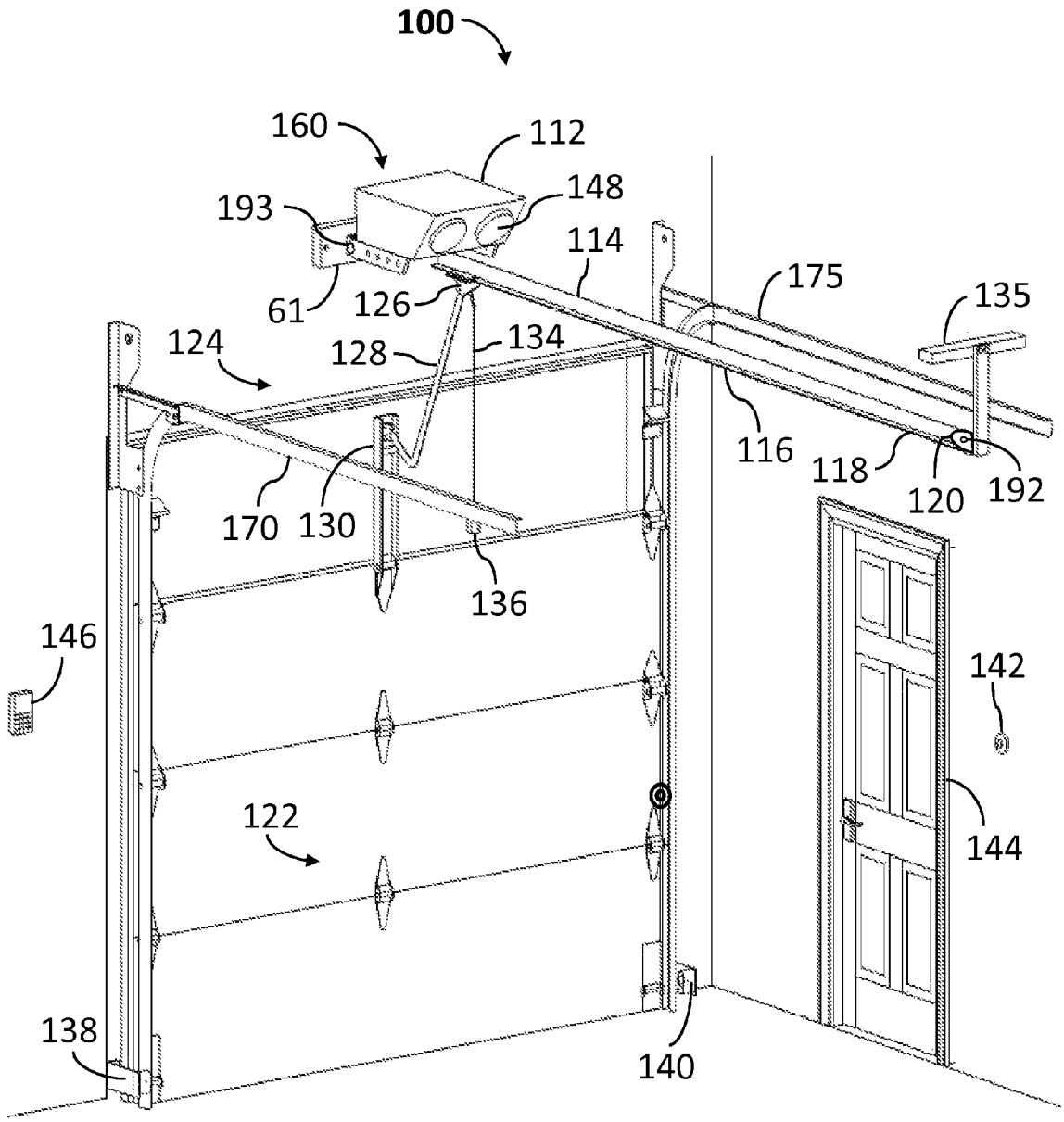
FIG. 2 (Embodiment 100) is a perspective view of a rail type garage door opener of the present invention, with a generic "Version A" drive assembly including its associated generic over-the-door pivotable mount.

Referring now to FIG. 2, a generic embodiment 100 of the present invention will be described, with the understanding that a number of details will differ in the specific embodiments to follow. Some of the components of the generic invention embodiment 100 are similar to the rail type garage door opener 10 (FIG. 1) of the prior art. However, a set of new elements for both the prior art drive assembly 12 (FIG. 1) and the prior art drive assembly mounting system 54 (FIG. 1) are essential to implement the garage door opener of the present invention. Specifics on these new elements are addressed further herein.

The generic invention embodiment 100 in FIG. 2 is comprised of a Version A drive assembly 112 to which the proximal end 114 of a rail 116 is attached. In accordance with the present invention, the Version A drive assembly 112 is mounted to the wall 124 with the generic above-the-door pivotable mount 160, by which the Version A drive assembly 112 is attached to the support block 61, which is in turn mounted to the wall 124 above the garage door 122, rather than being suspended from the garage ceiling. The pivotable mount 160 allows the drive assembly 112 to rotate about a horizontal axis via a pair of removable hinge pins 193 or equivalent structure (only one is shown in the drawing). In order to fit in this new location, the Version A drive assembly 112 cannot project so far from the wall of the garage as to impede upon the location of the J-arm 128. A review of a number of rail type garage door openers indicate that there is easily more than enough room; had there been a problem, it could have been resolved easily by increasing the size of the prior art J-arm 128 somewhat.

Unlike the distal end 18 of the rail 16 of the prior art (See, FIG. 1), in FIG. 2 the distal end 118 of the rail 116 is attached with the rail bracket 120 to a "T-shaped" bracket 135, or equivalent structure, which is mounted to the garage ceiling. As in the prior art, the distal end 118 of the rail 116 is attached to the rail bracket 120 with the prior art removable pin 192 (See, FIG. 1) or equivalent structure. In addition to the removable pin 192, the pair of removable hinge pins 193 secure the generic Version A drive assembly 112, so the generic embodiment 100 allows the entire drive assembly and rail to be structurally installed, removed, and reinstalled using only 3 removable pins, in contrast to the laborious and risky process of the prior art. As will be seen below, this advantage extends to all embodiments of the present invention herein.

In this representative depiction, the garage door 122 is sectional, and its movement is constrained by the tracks 170 and 175, which are normally suspended from the garage ceiling (not shown); however, the basic geometry of the rail type garage door opener of the present invention and it's operation described below essentially apply to all garage door classes.

Adaptation of Prior Art Units to Conform with Present Invention

An overall objective of the present invention is minimize the changes needed to make prior art garage door openers conform to the invention, while maximizing the advantages and benefits. For example, regarding the adaptation of prior art drive assemblies to conform to the present invention embodiment 100, it should be clear that if such drive assemblies utilize the "back" of the Version A drive assembly 112 (i.e., the side facing the garage wall) for "ancillary functions" such as lighting, controls, or wiring, then modifications to the drive assembly must be made. It is expected that if needed, changes to relocate these ancillary functions will be relatively minor.

Furthermore, it should be noted that while in the prior art in FIG. 1 the garage door 22 is opened when the trolley 26 moves towards the drive assembly 12, in FIG. 2 of the present invention the garage door 122 is opened when the trolley 126 moves away from the Version A drive assembly 112. At first, this might be considered to make it more difficult to convert prior art garage door opener systems to the present invention, but in fact it turns out that this is not the case. The present invention takes advantage of the realization that prior art garage door openers of the rail type have no "knowledge" of whether they are opening or closing a garage door, but they do have a "memory" of the direction of the previous actuation. As such, controls for garage door openers do not have a separate button for "open" or "close", but are based upon a toggle form of control, whereby the single button conveys to the drive assembly the command to move in the opposite direction to the previous actuation.

As a corollary to the above, it should be noted that prior art garage door openers employ "stops" to signal to the drive assembly that an actuation is complete. One way such stops are implemented relies upon the user placing a pair of "external" limit switches in the appropriate positions on the rail, one for each direction of travel. These switches are activated by the motion of the trolley, which send signals to the drive assembly when the trolley has reached the end of the excursion in one direction or another. The second approach that is commonly used to implement "stops" is that the drive assembly has an internal "odometer" that provides it with a measure of distance travelled. As a rule, the odometer function in the prior art has been provided by mechanical means, in that the rotation of the drive motor results in the linear motion of a part in the drive assembly that encounters "internal" limit switches inside the drive assembly. The position of the limit switches in the drive assembly are typically set into the proper position by the user via external screws.

Regardless of whether the garage door opener system utilizes "external" or "internal" limit switches, the present invention takes advantage of the fact that the "stops" for a prior art garage door opener actuation do not rely upon the direction of the trolley, or whether the garage door is being opened or closed. The stops are based upon feedback from simple position sensors, and do not depend upon the direction of the actuation. As such, under nominal conditions, once an actuation has been initiated, the drive assembly will move the trolley until it reaches signals from its position sensors to terminate the actuation.

An additional corollary to the above relates to operation under exceptional conditions regarding safety, such as when a physical object is sensed, and/or when the force being exerted by the drive assembly exceeds a safe threshold. The present invention takes advantage of the fact that the direction of motion is not relevant to the safety sensors in sensing that there is a potentially unsafe condition. Although he direction of motion can be important in the response of the garage door opener when it senses excessive force being applied, the required response is to immediately reverse direction. In the case of excessive force, while it is true that the force limits for open and close operations may differ, in practice these limits are adjusted by the installer, typically by controls on the drive assembly; they are not "wired in" to the system design. The present invention takes advantage of the fact that for the present invention, as in the prior art, after the force limit adjustments are made, the response of the garage door opener system will be correct irrespective of the direction of motion.

In the case of proximity sensors that sense when a physical object is sensed, the response of prior art systems is also independent of the direction of motion. As such, the response of the prior art garage door opener system will be correct irrespective of the direction of the commanded actuation.

It must also be acknowledged that when prior art units are structurally redesigned to conform with the current invention, there is an additional impact in such things as user instructions, such as setting stops, and/or the labeling of control functions. For example, a prior art drive assembly may have adjustment screws that are labeled with arrows, which are used to set the limits for "open" and "close" operations. With the present invention, these directions are reversed. These additional exceptions can be addressed with a modest effort by makers of garage door openers.

Versions of Drive Assemblies and Mounting Apparatus

The terminology "Version A", "Version B", and so on, is employed herein in order to distinguish between each embodiment of a drive assembly including its associated mounting apparatus. The inclusion of associated mounting apparatus in the "Version" terminology for the drive assembly is required to avoid ambiguity regarding the scope of the various embodiments presented herein.

Conformance of Present Invention with Safety Requirements

The previous discussion has pointed out in detail that the present invention is partly based upon the expectation that the architecture of the present invention embodiment 100 can largely be realized without making changes to the system of sensors and responses that govern the operation of prior art garage door opener systems. This expectation will be of great importance when dealing with the changes to be identified herein that are needed to implement specific embodiments of the present invention, in that these changes are expected to represent both the necessary as well as the sufficient means to reduce the present invention to practice.

The need for commercial garage door openers to have safety features, such as those that prevent entrapment of people beneath the garage door, are governed by federal requirements established by the Consumer Product Safety Commission (CPSC). To the extent possible, the current invention attempts to anticipate these requirements, and identify whether the current invention imposes any barriers to compliance with CPSC requirements. The fact that no such barriers have been identified herein does not relieve the makers of garage door openers from their responsibility to design and test their units independently before releasing them for production and sale.

Conformance of Present Invention with all Prior Art Operations

On the above basis, virtually all of the remaining discussion of FIG. 2 below, which deals with the operation of the present invention embodiment 100 of a rail type garage door opener, including all its ancillary functions, is essentially identical to that described in the prior art. The details are repeated to emphasize that the present garage door opener invention does not interfere with or impact any the fundamental modes and behavior of prior art garage door openers.

A trolley 126 can traverse along the rail 116. The movement of the trolley 126 is controlled by the Version A drive assembly 112, using any of several available, known rail mounted drive mechanisms (including, inter alia, screw drive, chain drive, and belt type drive systems). The trolley 126 is attached to the garage door 122 using a J-arm 128, which is attached to a door bracket 130 mounted near the top of the garage door 122.

Like the trolley 26 (FIG. 1) of the prior art, the trolley 126 can be disengaged from the drive mechanism associated with the rail based drive system using a latch integral to the trolley 126, which can be used to disengage the trolley 126 from the rail based system by means of a pull cord 134 which is attached, at one end, to the latch, and hangs down to a pull knob 136 which is used should there be a situation, i.e., a power outage, which requires manual operation of the garage door 122 when the Version A drive assembly 112 is not functioning.

As with the rail type garage door opener of the prior art 10 (FIG. 1), an "electric eye" safety system including a transmitter 138 and a receiver 140, act as safety devices to prevent the closing of the garage door 122 when its path is obstructed, i.e., by a person, vehicle, or other object, are also used with the present invention.

The present invention embodiment 100 also includes a wall mounted button 142, typically mounted adjacent to an interior door 144 between the garage and the house, and it may also include as well a hard-wired and/or a radio control unit 146 inside the garage, as well as outside the garage. All of these sources, together with remotes in automobiles, are used to control the movement of the garage door 122 by activating the Version A drive assembly 112. A typical Version A drive assembly 112 also includes a light 148 (or several) used to illuminate the garage for a period of time following activation of the Version A drive assembly 112, although some garage door openers allow the light to be activated independently of the garage door.

The pair of prior art mounting tabs 41 and 51 on the top of the case of the drive assembly 12 (See, FIG. 1) are not portrayed in the present invention embodiment 100 in FIG. 2, but similar structures are present in some of the embodiments to follow to serve a different function. The primary architectural difference between the generic invention embodiment 100 and the rail type garage door opener 10 of the prior art derives from the placement of the Version A drive assembly 112 above the garage door 122 with the pivotable mount 160, and the mounting of the distal end of the rail 116 to the garage ceiling. A number of modifications to drive assemblies, as well as various mounting designs, will be provided herein as representative means to implement the architecture of this invention.

For all the versions to be described below, the appropriate portion of the generic above-the-door pivotable mount 160 for the Version A drive assembly 112 can be secured to studs or a header above the garage door 122 before any variant of the Version A drive assembly 112 is lifted off the ground. No engineering is required by the installer (or homeowner) to provide a safe, secure mounting for any variant of the Version A drive assembly 112 which is affixed above the garage door 122 in a secure, uniform, and vibration-free installation.

Further, while the distal end 118 of the rail 116 must still be subsequently secured to the garage ceiling, doing so is substantially easier than suspending a heavy drive assembly from the ceiling, and there is relatively less potential harm if the distal end 118 of the rail 116 should become detached from its mounting 120, either during installation or subsequently.

As such, those familiar with rail type garage door openers will readily understand that mounting the Version A drive assembly 112 on the wall 124 above the garage door 122 using the generic above-the-door pivotable mount 160 which is securely attached to studs or a header will make for a more safe and secure mounting than suspending the drive assembly unit 12 (See, FIG. 1) from to the garage ceiling. Given that all of the prevalent art and literature for rail type garage door opener products uniformly call for mounting the heavy drive assembly to the ceiling in the middle of the garage (See, FIG. 1) the generic invention embodiment 100 is not at all obvious, as will be discussed in more detail herein.

Nevertheless, as the primary function of the drive assembly unit 12 (or Version A drive assembly 112) is to move the trolley 26 (or 126) along the rail 16 (or 116), it will be made apparent, given the present disclosure, that when the changes required by the invention are implemented, the generic invention embodiment 100 will operate substantially the same in this regard as the prior art 10, and will do so with all classes of garage doors. As described above, the generic invention embodiment 100 conforms with all the modes of the prior art with regard to ancillary functions involving safety. These ancillary functions include the sensing of objects through optical or similar means, the sensing of excessive resistive forces during activation, and the appropriate response to warnings from these sensors.

Embodiment of Version B Drive Assembly with Two Mounting Tabs

Figure 3:
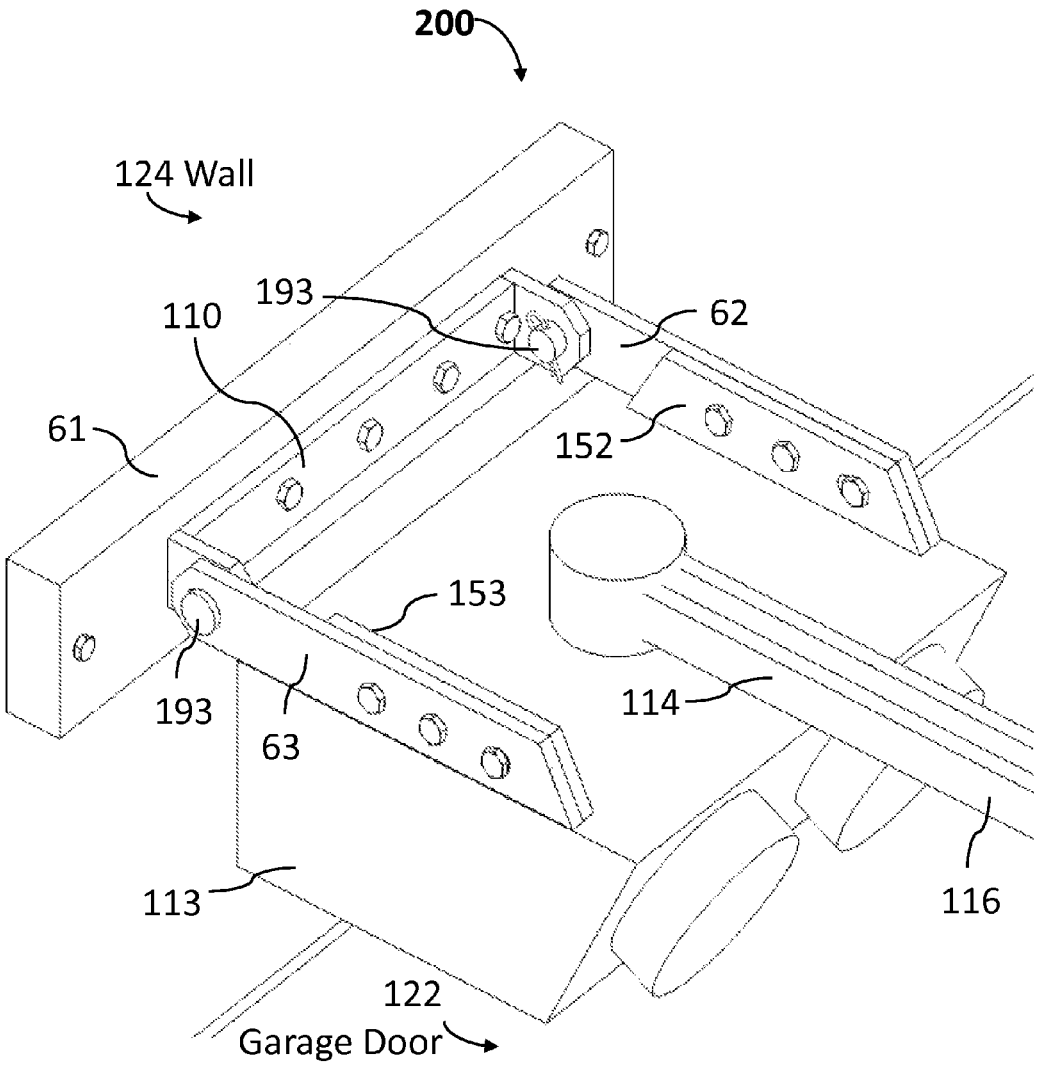
FIG. 3 (Embodiment 200) is a perspective view of a "Version B" drive assembly with two parallel mounting tabs in which the drive assembly pivot axis is over the drive assembly.

With particular reference to FIG. 3, a specific drive assembly embodiment 200 of the generic invention embodiment 100 (FIG. 2) is shown. Embodiment 200 is based upon utilizing the Version B drive assembly 113 with two integral mounting tabs 152 and 153, to which the support adapters 62 and 63 are mounted using appropriate fasteners. As shown, support adapters 62 and 63 extend the mechanical structure of the Version B drive assembly 113, allowing it to be connected to a hinge bracket 110 (details of which are provided in FIG. 4) with a pair of removable hinge pins 193. A support block 61, attached to the wall 124 over the garage door 122, is used to anchor the hinge bracket 110. For spatial reference, the proximal end 114 of the rail 116 is shown.

It should be noted that since the support adapters 62 and 63 change the mechanical loading on the mounting tabs 152 and 153 as compared to the loads on the mounting tabs in a prior art suspension mount, it will be necessarily for any supplier using this approach to certify that their existing structure is adequate for conformance with the Version B drive assembly configuration. If some structural modification is required, it is expected to be minor. For example, this could take the form of extending the mounting tabs 152 and 153 towards the back of the Version B drive assembly 113 (i.e., towards the wall 124), by fortifying the mounting tabs 152 and 153 and their underlying structural support within the Version B drive assembly 113, or by making the tab 152 integral with the support arm 62, and the tab 153 integral with the support arm 63.

While not shown in FIG. 3, those skilled in the art will realize that additional mechanical security can be achieved by a cross bar or equivalent means under the Version B drive assembly 113.

The removable hinge pins 193 facilitate the installation process as well as removal, repair, and replacement. The prior practice of securing the distal end of the garage door opener rail using a removable pin should be followed, since there is nothing in the above-the-door mount to preclude it. Therefore, embodiment 200 allows the entire drive assembly and rail to be structurally removed and reinstalled using only 3 removable pins, in contrast to the laborious and risky process of the prior art. As will be seen below, the significant advantage of the hinged structure in this embodiment versus to the prior art also applies to all the other embodiments depicted herein for the present invention.

Hinge Bracket for Version B Drive Assembly with Two Mounting Tabs

Figure 4:
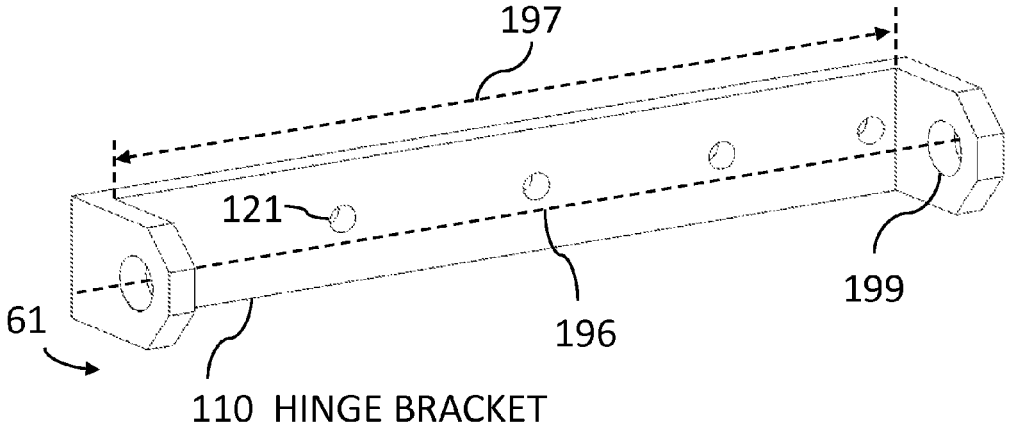
FIG. 4 is a perspective view of a hinge bracket for the "Version B" drive assembly in FIG. 3.

FIG. 4 isolates the hinge bracket 110, which depicts a mounting hole 121 of a set that are used to secure hinge bracket 110 to the support block 61, as well as the hole 199 provided for one of the removable hinge pins 193 (FIG. 3). As depicted in FIG. 4, the single part 110 guarantees that that the distance 197 will be as required, and that the axis of rotation 196 determined by the hole 199 (and its companion) at either ends of the part, as well as the axis of rotation defined by the Version B drive assembly 113 (FIG. 3), will be coincident. During installation, after the hinge bracket 110 has been pre-mounted, these attributes will ensure an accurate mate between the hinge bracket 110 with the prior drive assembly 113 (FIG. 3), avoiding the difficulty and potential danger of trying to deal with a mismatch when installing the Version B drive assembly 113 (FIG. 3) on the order of at least seven feet above the garage floor.

Embodiment of Version C Drive Assembly with One Mounting Tab

Figure 5:
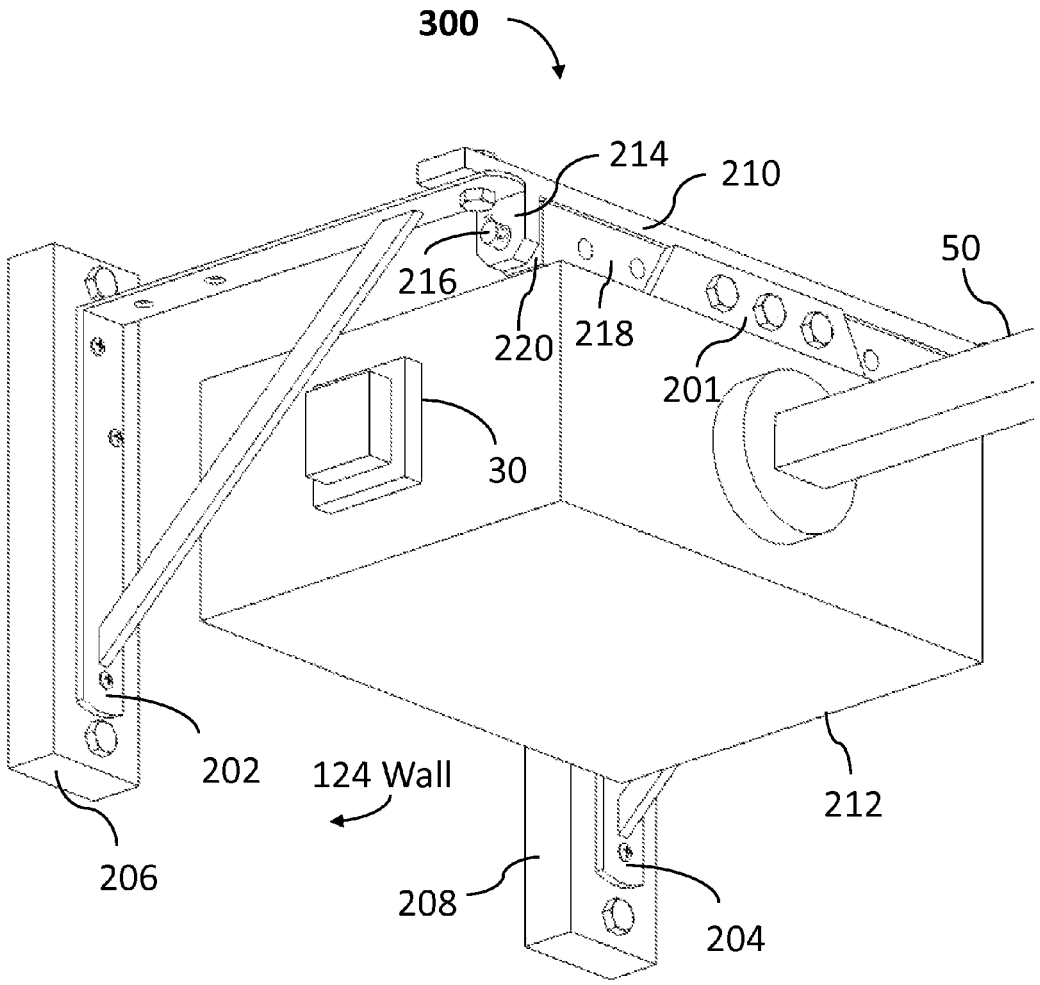
FIG. 5 (Embodiment 300) is a perspective view of a "Version C" drive assembly with a single mounting tab in which the drive assembly pivot axis is over the drive assembly.

With reference now to FIG. 5, another specific drive assembly embodiment 300 of the generic invention embodiment 100 (FIG. 2) is shown, which is based upon a Version C drive assembly 212 that has a single integral mounting tab 201 on the "front" of its case (i.e., the side nearest the rail 50). The Version C drive assembly 212 is shown with a light diffuser 30 on one side, while the rail 50 projects from the front of the Version C drive assembly 212, away from the wall 124. This drawing is based upon a unit that has a screw drive; as a rule, the rails for either chain or belt drives are essentially directly over the drive assembly, which would be difficult in this configuration, due to the presence of the mounting tab 201. However, embodiment 300 applies to all variations of Version C drive assembly 212 with a chain or belt drive mechanism, as well as a screw drive.

Embodiment 300 includes a pair of L-brackets 202 and 204, which are mounted securely using the appropriate means to the wall support members 206 and 208, which in turn are secured to the wall 124. A support cross bracket 210 spans the projecting ends of the L-brackets 202 and 204. As shown, the support cross bracket 210 is essentially a horizontal bar which has an ear 214 and a companion towards the other end of 210 that project downwards; both ear 214 and its companion have a hole for installing the removable pin 216 (i.e., a clevis pin, cotter pin or equivalent arrangement) and its companion.

The drive assembly suspension bracket 218 is essentially in the form of an elongated "C", and contains a series of holes in the middle of the bracket for securing it to the mounting tab 201 using the appropriate fasteners. An ear 220 of the drive assembly suspension bracket 218 is shown projecting towards the wall 124. Both ear 220 and another ear (not visible) at the other end of the drive assembly suspension bracket 218 are nested within the ears of the support cross bracket 210, and have appropriate holes to accommodate the removable pin 216 and its companion.

As one skilled in the art will recognize, while embodiment 300 depicts the L-brackets 202 and 204 essentially at the sides of the Version C drive assembly 212, it can easily accommodate inverting 202 and 204, and installing them essentially above the Version C drive assembly 212.

The removable pin 216 facilitates the installation process as well as removal, repair, and replacement. The prior practice of securing the distal end of the garage door opener rail using a removable pin 192 (FIG. 2) should be followed, since there is nothing in the above-the-door mount to preclude it. Therefore, embodiment 300 allows the entire drive assembly and rail to be structurally removed and reinstalled using only 3 removable pins, in contrast to the laborious and risky process of the prior art.

Installation Limitations of the Adaptation of Prior Art Drive Assemblies

With regard to installation, as will be discussed in more detail herein, one advantage of the hinged arrangements in drive assembly embodiments 200 and 300 is that the drive assemblies can be mounted to the wall with the distal end of the rail resting on the garage floor. However, because embodiments 200 and 300 propose the use of versions of drive assemblies with mounting tabs on the top, in both cases the axis of rotation is above the drive assembly. As such, the limit of their rotation towards the floor will be based on the height of the drive assembly box, as well as its distance from the wall (which is based upon the length of the horizontal portion of the L-brackets 202 and 204). If these factors don't allow the distal end of the rail to rest upon the floor, a box or similar means may be used to rest the distal end on during installation of drive assembly embodiments 200 and 300

Advantages of Drive Assemblies with Major Modifications

It is possible that based upon market conditions, suppliers of rail type garage door openers may ultimately choose to either redesign, or make substantial changes to existing units in order to meet demand for units conforming to the present invention more effectively. A large majority, if not all, makers of prior art drive assemblies will have to relocate ancillary functions so they will not be facing the wall of the garage, and while making the additional changes to conform with this invention, may attempt to do so while still maintaining backward installation compatibility with existing lines. A number of means to accomplish this while still minimizing the impact to prior art rail type garage door openers are provided below. To this end, a generic preferred embodiment of the present invention, which calls for more substantive changes to prior art drive assemblies, will be described below.

These changes are driven by a number of objectives. In general, it is preferred to support the drive assembly from the bottom, rather than have to adapt to the prior art attachment points on the top of the drive assembly, since such adaptations require a small "virtual suspension" of one type or another. Another focus of this embodiment is to provide a means of supporting the drive assembly that will work with rail type garage door openers from various manufacturers In addition, it is desired that the design support rails of various inclinations with regard to the horizontal, with the recognition that the required inclination of the rail will vary based upon the type of garage door and the supplier. Finally, the support system should take into account that it is far preferable to have a installation that does not require that both ends of the rail be raised to some extent or another at the same time during installation, and that the design will should allow incremental installation of the two ends of the rail type garage door opener. As such, such a garage door opener embodiment should be free of the installation limitations described regarding embodiments 200 and 300.

Embodiment of Version D Drive Assembly with Generic Bottom Support

Figure 6:
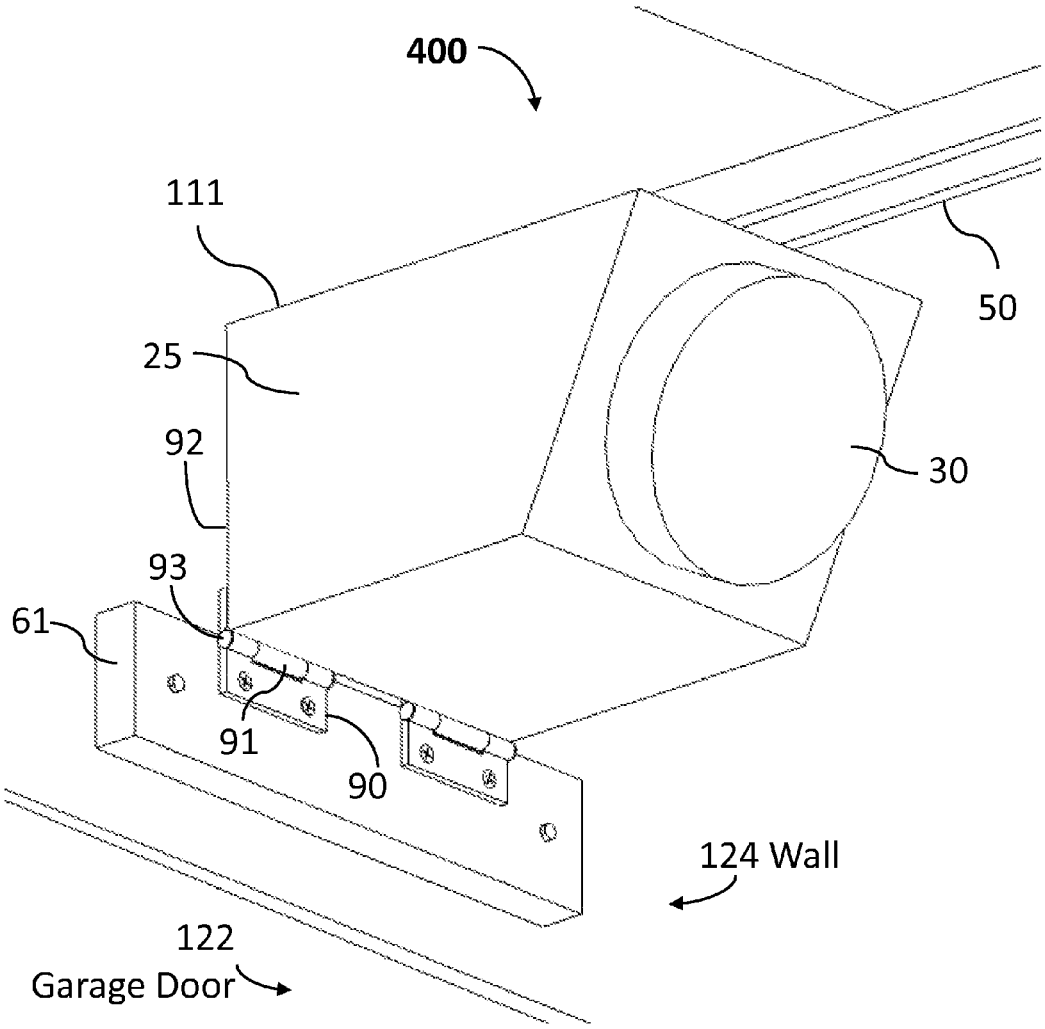
FIG. 6 (Embodiment 400) is a perspective view of a "Version D" drive assembly for a generic configuration with drive assembly pivot axis underneath the drive assembly.

Referring now to FIG. 6, drive assembly embodiment 400 discloses a generic means for incorporating the present invention into new and/or substantially modified drive assemblies. The Version D drive assembly 111 is seen installed to the wall 124 via the support block 61, above the garage door 122. Visible as part of the Version D drive assembly 111 are one side 25, and a light diffuser 30. Extending from the center of the top of the Version D drive assembly 111 is the proximal end of the rail 50. In general, depending upon the maker of the rail type garage door opener as well as the type of garage door, in order to perform correctly after installation, the rail 50 must decline from left to right in FIG. 6 at an angle specified by the garage door maker.

Using the appropriate techniques and fasteners for one skilled in the art, as required, the support block 61 is attached securely to the wall 124 above the center of the garage door, in most cases to the header and/or studs over the garage door 124 (in some cases, the support block 61 may not be needed). Again, using the appropriate techniques and fasteners, the hinge half 91 of a hinge 90 is mounted securely to the support block 61. As shown in FIG. 6, an identical hinge to hinge 90 is shown at the other side of the Version D drive assembly 111, and installed in the same manner as hinge 90. Clearly, this approach can be extended to more than two hinges—the discussion below specific to hinge 90 should be understood to apply to a plurality of hinges.

In accordance with FIG. 6, the drive assembly hinge element 92 of the hinge 90 is securely attached to the drive assembly, such that the location of the axis of rotation embodied by the hinge pin 93 of the hinge 90 will be essentially under the Version D drive assembly 111 as shown. (Embodiments detailing the means by which the hinge element 92 can be supported and incorporated into the generic Version D drive assembly 111 will be addressed later herein).

In summary, the generic hinged configuration in FIG. 6 for the support for drive assembly 111 allows it to rotate about the axis embodied by the hinge pin 93, which is parallel to the top of the garage door 122, and essentially under the drive assembly 111. The extent of the rotation of the hinge 90 is not constrained in any practical way; when the garage door opener in embodiment 400 is fully assembled with the rail, the hinge arrangement can easily accommodate the full angular range required, from the angle at which the distal end of the rail reaches the ceiling to the angle at which it touches the floor.

While FIG. 6 illustrates the hinge half 91 of the hinge 90 attached to the support block 61 essentially below the drive assembly 111, it is also possible that one skilled in the art could mount the hinge half 91 to the support block 61 such that it is essentially above the drive assembly 111.

In general, as anyone skilled in the art will realize, there are multiple variations regarding the embodiment 400 in FIG. 6 regarding the application of hinges. For example, a single "piano hinge" could be used that substantially spans the width of the drive assembly, or two or more individual hinges could be used. Those skilled in the art will recognize that the "leaf" (half-hinge) of the hinge "attached" to the drive assembly could be implemented by making this structure integral to the drive assembly. In addition, the hinge pins can be fixed permanently to the hinges, or various means, such as the use of cotter pins and or clevis pins, can allow the hinge pins to be safely removed when appropriate.

The above variations will be discussed below with specific embodiments of the generic drive assembly embodiment 400, which pertains to new and/or substantially modified drive assemblies. In general, the advantages of the generic design approach of embodiment 400 with a hinged support mechanism are twofold: it allows the drive rail 50 to be inclined at arbitrary angle (specified by the rail type garage door opener supplier) versus the horizontal, and (as will be described below in detail) greatly eases the installation process, allowing easy compliance with the slope of the rail required by the maker of the garage door opener. Once the installation is complete, the rotational degree of freedom provided by the hinge 90 is of course not required until the garage door opener is removed and replaced, when it again becomes quite useful. While the increased component cost of using a hinge arrangement instead of a fixed mount is trivial, the advantages are considerable, during both installation and removal.

Embodiment of Version E Drive Assembly with Bottom Support

Figure 7:
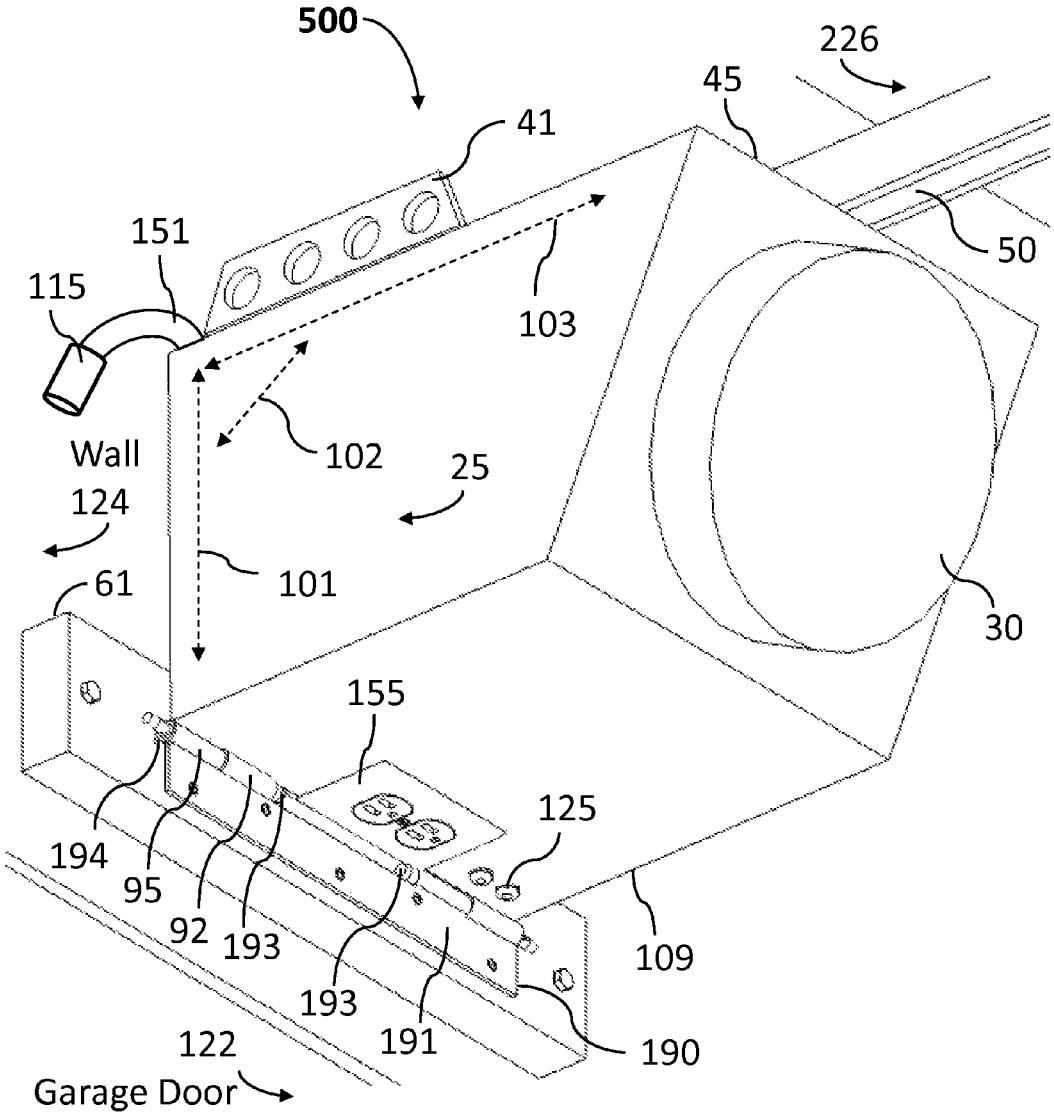
FIG. 7 (Embodiment 500) is a perspective view of the embodiment of a "Version E" drive assembly consistent with FIG. 6.

FIG. 7 depicts a detailed drive assembly embodiment 500 consistent with the generic drive assembly embodiment 400 presented in FIG. 6. Embodiment 500 is centered around a Version E drive assembly 109 attached to the rail 50, which is shown under the garage ceiling 226, with side 25 and light diffuser 30. In embodiment 500, the hinge part 191 of the hinge assembly 190 is attached to the support block 61, which is mounted to the wall 124, and has an integral cylindrical structure 95 at either end (a detailed drawing of the hinge part 191 will be provided in FIG. 8). Integral to the body of the modified Version E drive assembly 109 are drive assembly hinge elements 92 at either side, which mate to the cylindrical structures 95 via a pair of hinge pins 193 on either side. In this view, the drive assembly hinge elements 92 of the Version E drive assembly 109 nest between the cylinder structures 95, but the opposite arrangement can work as well.

Clearly, drive assembly embodiment 500 can be expanded to utilize more than two instances each of parts 95, 92, and 193, but this complexity is not needed unless the loads on the hinge assembly 190 are excessive. As such, while an identical set of hinge components is shown at the other end of the Version E drive assembly 109, the discussion herein applies to the second hinge, and as well as to a plurality of hinges.

The removable hinge pins 193 in the embodiment 500 are secured in place with a pair of retaining pins 194 (clevis pin or cotter pin, or equivalent), which are mounted in this figure towards the outside of the Version E drive assembly 109 to make them more visible and accessible. For reasons of visibility, hinge part 191 is depicted as attached to the support block 61 below the axis of rotation of the hinge assembly 190, but it is clear that hinge part 191 could be mounted to the support block 61 above the pair of removable hinge pins 193, which may preferred as an attachment location or to reduce visual clutter.

Alternatively, the function of hinge part 191 could be provided by a pair of wall-mounted "ears" on either side of the Version E drive assembly 109 in which the pair of removable hinge pins 193 terminate. All in all, there are far too many variants of this hinging arrangement to enumerate all cases here, and the set of examples provided herein are included to reflect some of the more evident ones that might be considered by one skilled in the art.

The two removable hinge pins 193 facilitate the installation process as well as removal, repair, and replacement. The prior practice of securing the distal end of the garage door opener rail using the removable pin 192 (FIG. 1 should be followed, since there is nothing in the above-the-door mount to preclude it. Therefore, embodiment 500 allows the entire drive assembly and rail to be structurally removed and reinstalled using only 3 removable pins, in contrast to the laborious and risky process of the prior art.

For flexibility in installation, FIG. 7 depicts a parallel prior art mounting tab 41, with the understanding that there is an identical parallel tab on the other side of the Version E drive assembly 109, and in addition, a single prior art mounting tab could be provided along the edge 45 on the top of the Version E drive assembly 109 (this tab is not included in the drawing). The inclusion of these three prior art mounting tabs allows the Version E drive assembly 109 to be used in suspended manner, so it can be backwards compatible with prior art installations.

Given the ease of mechanical connections that are now afforded by removable pins, it makes sense to consider an easier method of making and breaking the electrical connections (other than AC power) to the drive assembly, which in the prior art has been achieved with a bundle of wires that connect the drive assembly to wall switches, safety sensors, and so on. As such, embodiment 500 proposes that all wires except AC power are provided in a wire cable 151, which terminates in a connector 115.

In spite of the numerous drawbacks that derive from the traditional practice of suspending drive assemblies from the ceiling of garages, this generally central location has some advantages in providing illumination throughout the garage, for both visibility and security. However, the quality of this illumination varies, as there is no common arrangement regarding lighting amongst the various vendors of rail type garage door openers.

Some rail type garage door openers have provision for one light bulb, and some have provision for two. In some cases in the prior art the light bulb socket or sockets are at the end of the drive assembly facing away from the garage door, in some cases there is a single light bulb socket on one side of the drive assembly, and in other cases there are light bulb sockets on both sides of the drive assembly. The use of diffusers, typically made of plastic materials, is also not standard. For practical reasons, none of the major suppliers of rail type garage door openers have a light source on the bottom of the drive assembly, so that light can be distributed more evenly. Since drive assemblies have plastic end panels close to the light bulbs, and/or plastic diffusers for them, the allowable wattage for the lighting elements is generally limited.

In providing illumination from drive assemblies designed to be mounted over garage doors, there are some measures that can be taken to compensate for their mounting location, such as using a mini-spotlight pointed towards the garage interior. However, the biggest challenge for such units occurs when the garage door is fully open, which prevents direct light from propagating throughout the garage. Due to the advent of fluorescent and/or LED light bulbs, this situation can be mitigated somewhat, as these light sources can provide a factor of about four times that of incandescent bulbs for the same wattage. Using these light sources with an over the door drive assembly can improve the lighting situation in most circumstances.

However, in order to provide maximum flexibility, a workaround for this challenge is presented by providing the AC outlet 155 in FIG. 7. The AC power from this outlet would be switched on by the drive assembly during the periods when the nominal lighting sources in the drive assembly are powered. As such, one or two inexpensive wall or ceiling mounted light fixtures connected to this outlet could be installed at appropriate locations, such as on one or both sides of the garage door. At a slight incremental expense, the outlet could be of the GFI (Ground Fault Interruption) type, such that a licensed electrician could install light fixtures on the exterior of the garage, perhaps under the eaves.

In case it is preferable to have switched DC power, a DC outlet 125, and a companion outlet, are also shown. The capability provided by either switched AC and/or DC power could be tailored to each installation, and can in some cases provide additional security outside the garage, something not afforded by current rail type garage door openers. It should be noted that some rail type garage door openers allow the option of turning on the lighting independently of opening or closing the door; in such cases, the advantages of having auxiliary lighting inside and/or outside the garage are enhanced, providing better visibility and security.

Changes to the vast majority of prior art drive assemblies to structurally accommodate embodiment 500 in FIG. 7 are relatively minor. Since traditional rail type garage door openers have been suspended by tabs on the upper surface, these tabs are commonly integral with a rigid sheet metal plate that forms the upper plane of the drive assembly box. This sheet metal plate also serves as a platform to attach the drive motor and gear assembly, and to anchor the proximal end of the rail as well. In fact, this sheet metal plate is the only truly rigid portion of the housing of prior art drive assemblies; the front and back are often molded plastic sheets, and the remaining three sides (the sides and the bottom) are often a "U-shaped" thin sheet metal piece. As used herein, the term "chassis" refers to the metal structure used in the above manner in a drive assembly.

In order to structurally accommodate the embodiment 500 of FIG. 7, one approach to do so with minimal impact upon existing chassis designs is with a redesign of the previous art chassis to include additional sheet metal and/or rigid structure extending downward from the rear (towards the wall in FIG. 7) in the prior art chassis, such that the drive assembly hinge structure can be made part of this extended chassis.

The extended chassis design can be accomplished by having an L-shaped chassis structure in which the upper (horizontal) portion of the "L" is virtually unchanged vs. the prior art chassis, while the back (vertical portion) consists of a structure substantially extended from the rear of the prior art chassis (the angle of the "L" is substantially a right angle). The new rigid structure on the rear of the chassis can be implemented with sheet metal and/or alternate means familiar to one skilled in the art.

It is expected that some bracing on the sides of the L-shaped chassis structure will be required to maintain its shape, but altogether the increased material and mass required to incorporate the hinge structure and fortify the chassis should be relatively minor.

Referring again to the embodiment 500 in FIG. 7, the dotted line 103 on side 25 of the Version E drive assembly 109 denotes the edge of the nominal position of the single-plane horizontal chassis of traditional drive assemblies, which is essentially the top portion of such drive assemblies. The dotted line 101 on side 25 denotes the edge of the plane containing the other (substantially vertical) portion of the "L", which extends mechanical support from the plane designated by the dotted line 101 to the drive assembly hinge element 92, while the dotted line 102 represents any bracing that may be required between the planes referenced by the dotted lines 103 and 101. Clearly, the Version E drive assembly 109 could be fortified by extending the chassis structure in other variants of this approach.

Hinge Part for Version E Drive Assembly with Bottom Support

Figure 8:
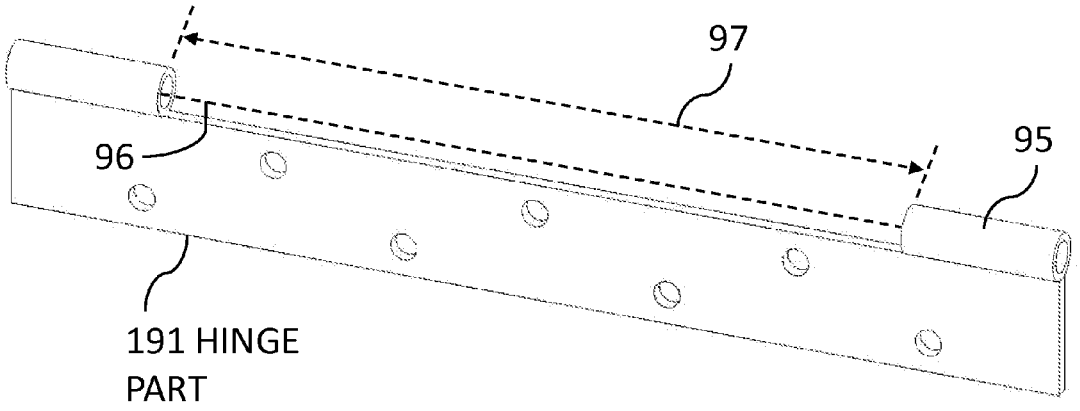
FIG. 8 is a perspective view of a hinge part for the "Version E" drive assembly in FIG. 7.

Referring now to FIG. 8, the hinge part 191 of FIG. 7 is depicted in order to highlight its features. While a pair of hinge "leaves" could be used to accomplish the same function as hinge part 191, it is clear that having a single part guarantees that the axis of rotation 96 defined by the cylindrical structures 95 at either ends of the hinge part 191, as well as the axis of rotation defined by the hinge elements 92 (FIG. 7) of the Version E drive assembly 109 (FIG. 7), will be coincident, and that in addition, the distance 97 will be correct.

During installation, these attributes will ensure an accurate mate between the hinge part 191, which is essentially wall mounted, and the Version E drive assembly 109 (FIG. 7), avoiding the difficulty and potential danger of trying to deal with a mismatch when installing the Version E drive assembly 109 (FIG. 7), at an elevation of seven feet or more above the garage floor.

In FIG. 7, drive assembly embodiment 500 introduces a need to have a rigid structure internal to the Version E drive assembly 109 to interface with the hinge assembly 190, which supports the Version E drive assembly 109 and the proximal end of the rail 50.

A means for providing the required structural support in the Version E drive assembly 109 begins with the recognition that the prior art position of the drive assembly chassis is essentially contained within the upper plane of the drive assembly, whereby the chassis provides a common platform for suspending the drive assembly, as well as anchoring the drive mechanism and rail. This suggests that the structure in the upper plane of the Version E drive assembly 109 can be extended to interface with the hinge assembly 190.

Chassis for Version E Drive Assembly with Bottom Support

Figure 9:
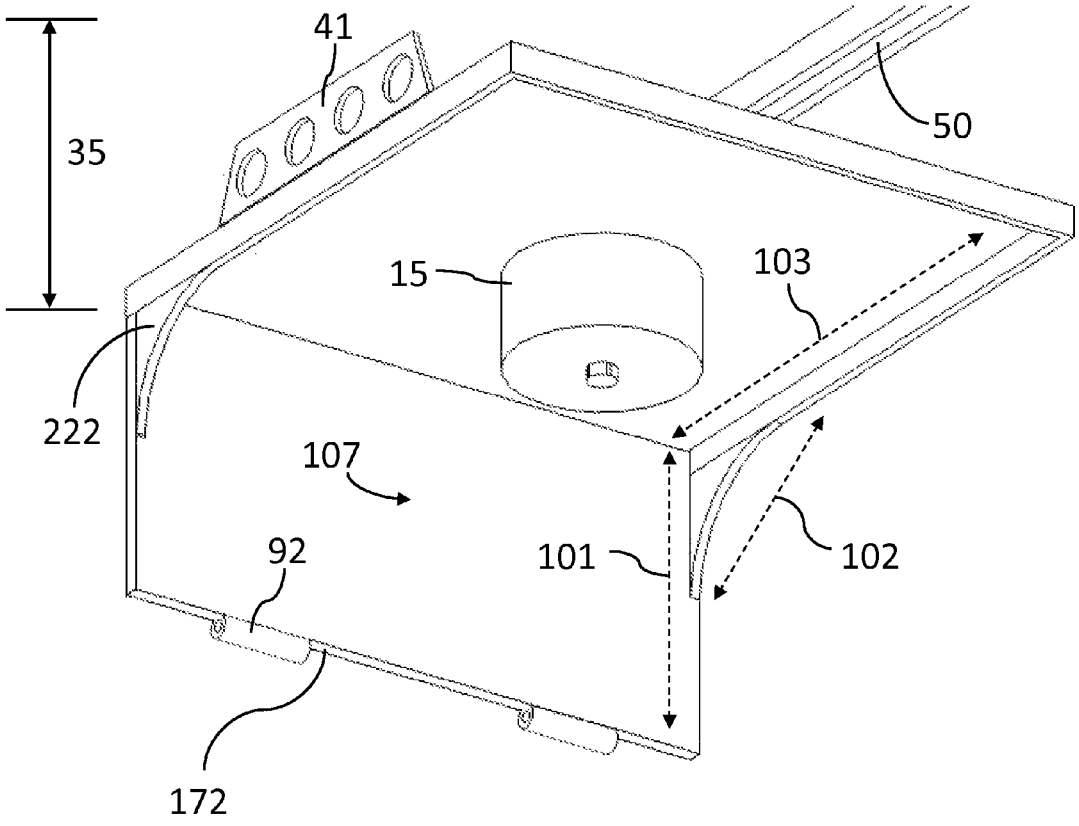
FIG. 9 is a perspective view of the chassis detail for the "Version E" drive assembly in FIG. 7.

To meet the above objective of extending the prior art chassis, FIG. 9 contains is a perspective view of a dual plane drive assembly chassis 172 which meets the needs implicit in embodiment 500 in FIG. 7. In the upper half of FIG. 9, the extent of a prior art chassis domain 35 is shown, which is essentially contained with the horizontal plane designated by the dotted line 103. The prior art chassis domain 35 is shown with a structure 15 that is a generic representation of the motor and drive gears, and the proximal end of the rail 50, which is attached to the top of the prior art chassis domain 35. One parallel prior art mounting tab 41 (of a pair) is depicted in order to make this chassis compatible with prior art mounts.

In the chassis embodiment in FIG. 9, the prior art chassis domain 35 has been enlarged by extended structure 107, which is contained within the essentially vertical plane designated by the dotted line 101. The extended structure 107 added to the prior art chassis domain 35 includes the drive assembly hinge element 92 and its identical parallel companion, and may contain a brace structure 222, consistent with the dotted line 102, that provides support between the planes designated by the dotted lines 103 and 101. The essentially "L" shaped structure of the dual plane drive assembly chassis 172 is a novel means of providing support for the hinged arrangement in the present invention, with minor impacts to prior art chassis designs.

It will be recognized by those skilled in the art that there are manifold variations of the means presented by FIG. 9 to provide this required support. For example, the extended structure 107, which is shown as essentially a plane that could be fabricated in sheet metal, could be implemented with rigid bars that extend in a braced manner from the prior art chassis domain 35 to the drive assembly hinge element 92 and its companion. This variation, which is essentially an alternative way of providing an "L" shaped structure, as well as other variations, can all be achieved within the fundamental approach shown in FIG. 9, with minor impacts to prior art chassis designs.

Embodiment of Version F Drive Assembly with Bottom Support

Figure 10:
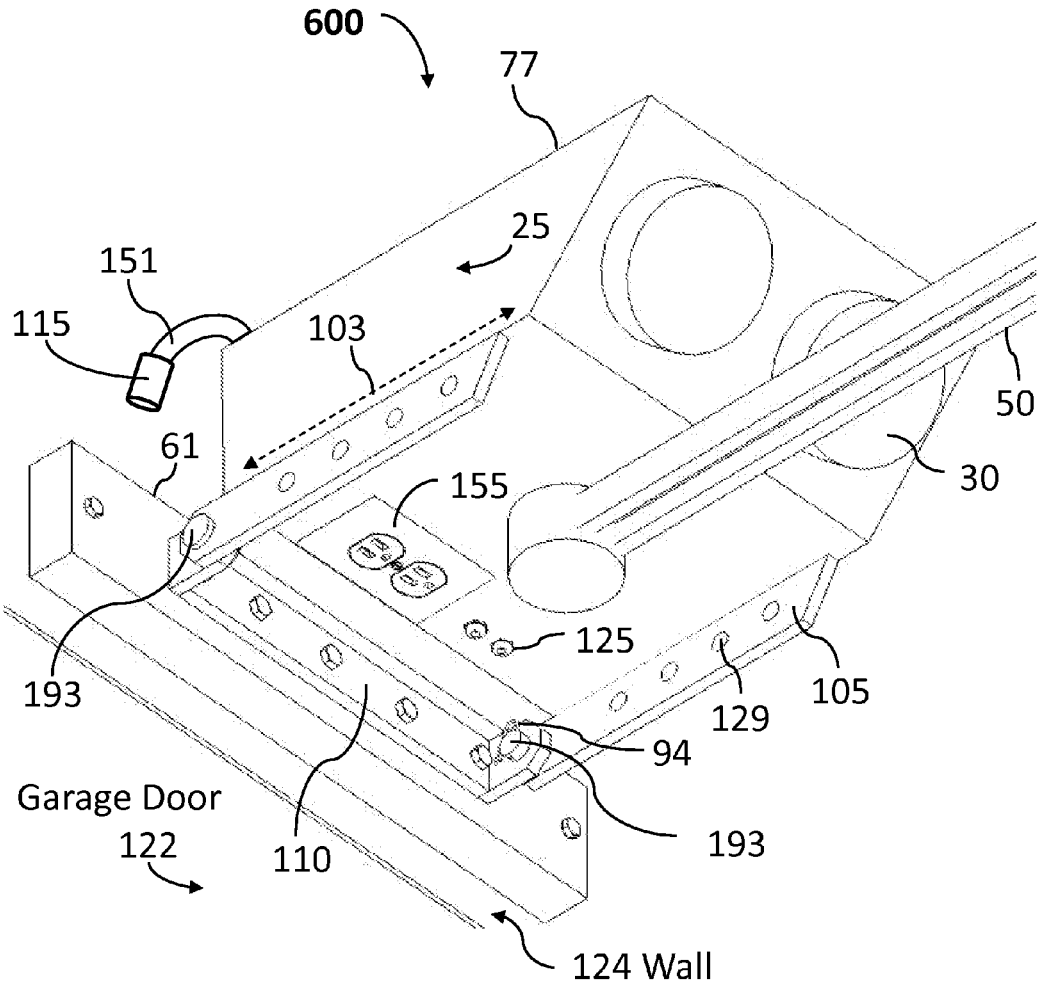
FIG. 10 (Embodiment 600) is a perspective view of the embodiment of a "Version F" drive assembly consistent with FIG. 6.

FIG. 10 depicts a detailed view of a novel drive assembly embodiment 600 consistent with the generic drive assembly embodiment 400 presented in FIG. 6. In the embodiment 600, the Version F drive assembly 77 can interpreted as a prior art drive assembly (e.g., 12 in FIG. 1) that has been has been inverted (turned upside down) and modified. In this embodiment, rather than introducing structure in a second chassis plane (as in FIG. 9), after inversion the prior art chassis is extended to support a hinged arrangement, so that it remains substantially a single horizontal plane with an edge denoted by the dotted line 100.

In drive assembly embodiment 600, the Version F drive assembly 77 is shown over the garage door 122, with side 25, the light diffuser 30, and is affixed to the rail 50. Embodiment 600 includes the switched AC outlet 155, the switched DC outlet 125, and also depicts a cable 151 and connector 115 for electrical signals other than power to the Version F drive assembly 77.

As described above, a key distinction of the Version F drive assembly 77 in embodiment 600 is that its structure is "flipped over" versus the prior art, so the rail 50 is now below it, and its chassis 171 (in FIG. 11), substantially in a plane whose edge is denoted by the dotted line 101, and is now at the bottom of the Version F drive assembly 77.

In embodiment 600, in place of a parallel prior art mounting tab (41 in FIG. 7), which in the prior art would now extend below the drive assembly on either side, there is a more robust support arm 105, and its identical and parallel companion, which are an integral part of the single plane drive assembly chassis 171 (detailed in FIG. 11).

Support arm 105 and its companion extend beyond the back of the Version F drive assembly 77, where they are mated to the hinge bracket 110 via the removable hinge pins 193, either of which can be removed using the retaining pin 94 (clevis or cotter pin, or equivalent) and its companion. The hinge bracket 110 is attached to the support block 61, which is in turn mounted to the wall 124.

Because of the similarity in mounting approach between drive assembly embodiment 600 in FIG. 10 and drive assembly embodiment 200 in FIG. 3, the hinge bracket 110 (detailed in FIG. 4) that was utilized in embodiment 200 is also used in drive assembly embodiment 600. As such, the advantages of utilizing a single part as the hinge bracket 110 in embodiment 600 are the same as those pointed out in the discussion regarding embodiment 200, in that a single part ensures an accurate mate with the drive assembly, avoiding the risky challenge of dealing with a mismatch when installing the drive assembly high above the garage floor.

The two removable hinge pins 193 facilitate the installation process as well as removal, repair, and replacement. The prior practice of securing the distal end of the garage door opener rail using removable pin 192 (FIG. 1) should be followed, since there is nothing in the above-the-door mount to preclude it. Therefore, embodiment 600 allows the entire drive assembly and rail to be structurally removed and reinstalled using only 3 removable pins, in contrast to the laborious and risky process of the prior art.

Regarding correct operation of traditional drive assemblies when "flipped over", there are no known internal functions within these drive assemblies, either electrical or mechanical, that rely upon gravity, and that would be rendered problematic by this inversion. However, the inversion of the drive assembly rail 50 in embodiment 600 does pose a geometric challenge. Since many rails in traditional drive assemblies have a channel facing the floor that the trolley traverses, or have some other design aspect, such that if the rail is simply inverted with the drive assembly, it can no longer function correctly. However, it will be seen that the need for any mechanical modifications to allow the rail to function correctly, as well as the need to modify the existing chassis plane to the hinged arrangement approach depicted by embodiment 600, require minimal impacts to traditional drive assemblies.

Ideally, the inversion of the Version F drive assembly 77 could be achieved without changes to its interface to the rail 50, but this is rarely the case. Therefore, the remaining challenge for makers of prior art drive assemblies in implementing the design in FIG. 10 is to minimize any accommodations required between the Version F drive assembly 77 and the rail 50. All rail-based rail type garage door openers have a trolley that travels under the rail, and as such almost all cannot be made to operate correctly if they are "flipped over" together with the drive assembly, as the trolley would then pointing upwards rather than downwards. An exception to this incompatibility are some rails that are beams with a square cross section, over which a trolley with a square internal cross section traverses. If a unit with such a beam is turned over, and the trolley is subsequently turned over as well, the trolley will end up back in its original orientation, and will operate correctly.

However, in general, some changes to prior art designs will be required to deal with the inversion of the drive assembly. To analyze how this can be done, it is useful to consider screw drive mechanisms separately from those that utilize a chain or a belt. Drive assemblies with screw drive mechanisms have a drive motor and set of gears that rotates a spindle at the front of the drive assembly that is connected to an elongated screw in the rail. The rail is mounted to the top of the drive assembly, and has a slot at the bottom to allow the trolley to traverse. The preferred accommodation required in this case is to have a means of mounting the rail to the drive assembly such that the slot will point either up or down, so the unit can be utilized with the rail either over or under the drive assembly.

Existing drive assemblies that utilize a chain or belt have a sprocket on the top of the drive assembly, driven by a motor and set of gears, that drives a continuous flexible loop (for chain drives, a portion of this loop is often a wire cable) to and from a pulley mounted at the distal end of the rail. Some such units have a rail with a "T" cross section, in which the flat portion at the top of the "T" is bolted to the chassis on the top of the drive assembly (with the result that the "T" is upside down). Typically, for such units the trolley rides over the flat portion of the "T".

One simple approach in this case is to just replace the "T" rail with one that has a square cross section (as described above), since there is no strong coupling between the design of the drive assembly and the design of the rail. It is also likely that one skilled in the art can design an adaptor that allows the "T" be mounted either up or down. For example, a square sleeve can be designed into which the "T" section can be secured, such that the square sleeve can then mounted to the drive assembly in the preferred orientation. It is quite likely that there are preferable alternatives to the ones presented here.

In general, the accommodations required to support inversion of the drive assembly, while retaining the flexibility to operate in traditional mounts, are very modest, although they do vary from unit to unit. It is likely that for the next generation of products that are specifically targeted for over the door installation, vendors will favor the units that are easiest to modify, either at the factory and/or by the consumer. In addition, they are likely to favor units that can be used for new installations while maintaining backwards compatibility with existing product lines, which will allow them to terminate the production of older units, while continuing to provide replacements that conform to fit, form, and function of units from the discontinued lines.

In pursuit of this goal, modifications required to support the "upside down" configuration can be made an option, such that garage door openers in the 600 embodiment could be configured by the installer to work "upside down" and well as "up". In the "up" orientation, the support arm 105 and its companion could be used as tabs for traditional suspension mounts.

There is a potential fit issue with above-the-door rail type garage door openers and garage doors that employ torsion springs to balance the garage door. Such springs are mounted on rods that are mounted on the wall above the garage door opening, and extend substantially from one side of the garage door to the other (for garage doors that do have not torsion springs, the area opening is typically completely unobstructed). For most units, installing the Version F drive assembly 77 of FIG. 10 over the garage door 122 requires that about 6" of headroom be available on the wall 124 either above or below the rail 50 (this is based upon the height of the Version F drive assembly 77). As such, the flexibility to have the rail 50 either above or below the Version F drive assembly 77 should accommodate virtually all garage doors with torsion bars.

Chassis for Version F Drive Assembly with Bottom Support

Figure 11:
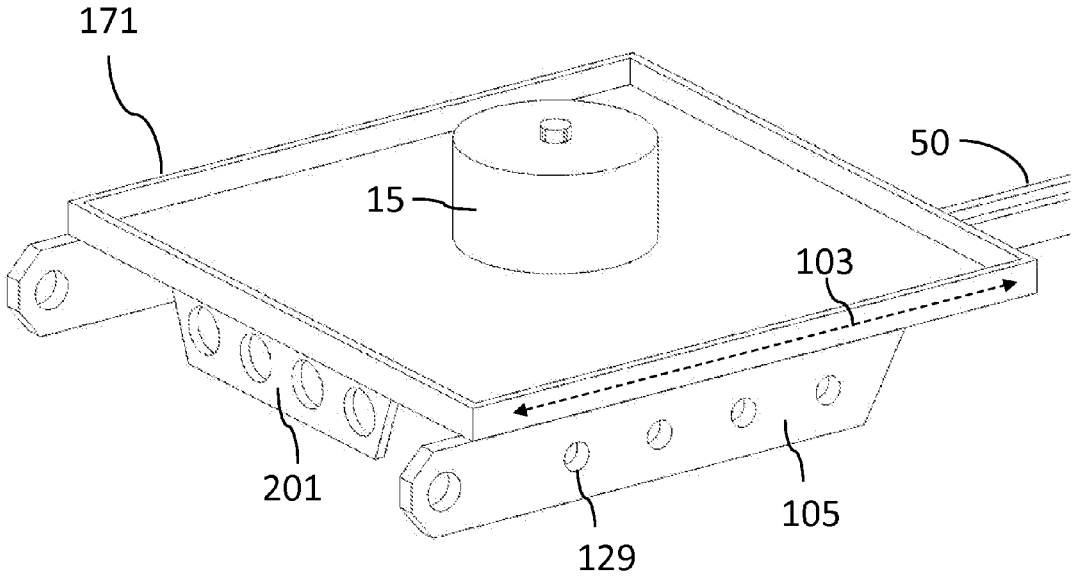
FIG. 11 is a perspective view of the chassis detail for the "Version F" drive assembly in FIG. 10.

FIG. 11 contains is a perspective view of a single plane drive assembly chassis which is in accordance with the embodiment 600 in FIG. 10. In FIG. 11, the structure 15 is a generic representation of the motor and drive gears, and the proximal end of the rail 50 is attached to the single plane drive assembly chassis 171. The single plane drive assembly chassis 171 is essentially contained within the single horizontal plane designated by the dotted line 103. It has been noted herein that prior art drive assemblies with suspension mounts either had a parallel pair of mounting tabs projecting upwards from both sides of the drive assembly, or a single mounting tab projecting upwards from the "back" of the drive assembly (i.e., the side opposite the rail).

Compared to prior art drive assemblies with a pair of mounting tabs, the single plane chassis 171 is similar to the prior art. The key differences are other the introduction of the support arm 105, and its identical parallel companion in lieu of a parallel prior art mounting tab (41 in FIG. 7), and the novel arrangement whereby the drive assembly has been inverted so that the chassis plane denoted by the dotted line 103 is now at the bottom of the Version F drive assembly 77 (FIG. 10), such that the rail 50 is now below the Version F drive assembly 77 (FIG. 10), rather than above it, as in the prior art.

A mounting hole 129 in the support arm 105 is shown to demonstrate the intent that a series of such holes allows the Version F drive assembly 77 (FIG. 10) to actually be inverted back to the traditional orientation (with the single plane chassis 171 back on the top of the Version F drive assembly 77 (FIG. 10), whereby it can be suspended from the garage ceiling. Alternatively, the support arms 105 allow the Version F drive assembly 77 (FIG. 10) to be mounted in the orientation depicted in FIG. 3, where they would replace the support adapters 62 and 63.

In addition, the embodiment of the single plane chassis 171 has a single mounting tab 201, which can be used as a suspension mount in the inverted state to replace a prior art drive assembly with a single mounting tab (In order to reduce visual clutter in FIG. 10, prior art mounting tab 201 is not shown; it would project downwards from the bottom edge of the Version F drive assembly 77, near the wall 124).

It will be recognized by those skilled in the art that there are manifold variations of the means presented in FIG. 11 to provide this required support for the hinge arrangement in the present invention within essentially a single chassis plane. These variations can be achieved within the fundamental design in FIG. 11 with minimal impacts to prior art chassis designs.

Generic Installation Geometry Component 1

While the present invention does not constrain the actual installation, it provides the degrees of freedom to support a number of simple variations. The invention enables the simple generic installation geometry presented below with the understanding that minor adjustments may be required for specific rail type garage door openers and specific installation sites. This level of detail is provided to demonstrate to those who are not skilled in the art that the installation geometry enabled by the current invention is as simple and direct as asserted herein, something that those skilled in art may deduce directly. It is expected that both those skilled in the art, as well as those who are not, will appreciate these advantages, as both groups have no doubt suffered from the laborious and risky installation constraints of the prior art.

Figure 12:
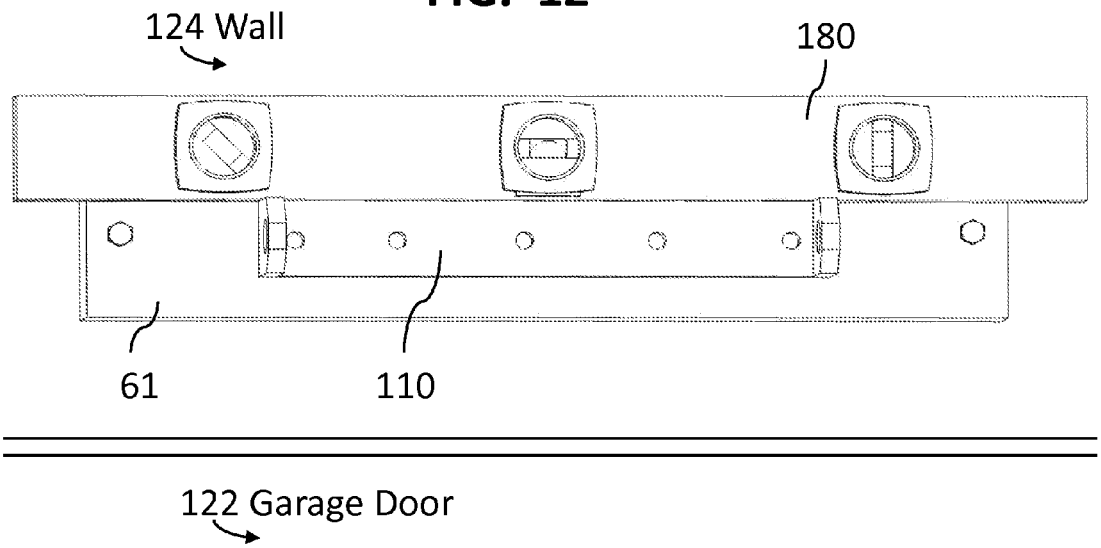
FIG. 12 is a perspective view of the first component of a generic installation geometry for the present invention.

In the example installation geometry described below, the novel drive assembly 77 embodiment presented in embodiment 600 in FIG. 10 is utilized, although the geometry is essentially the same for all the embodiments and variants of the present invention discussed herein, including embodiments 200, 300, 400, 500, as well as 600. The first stage in Component 1 of the generic installation geometry is depicted in FIG. 12, in which a support block 61 is mounted on the wall 124, over the center of the garage door 122 at the appropriate height, the hinge bracket 110 positioned over the support block 61 at the appropriate height, which allows a bubble level 180 or other means to ensure that 110 is level, such that hinge bracket 110 can be securely attached to the support block 61 using the appropriate fasteners.

Generic Installation Geometry Component 2

Figure 13:
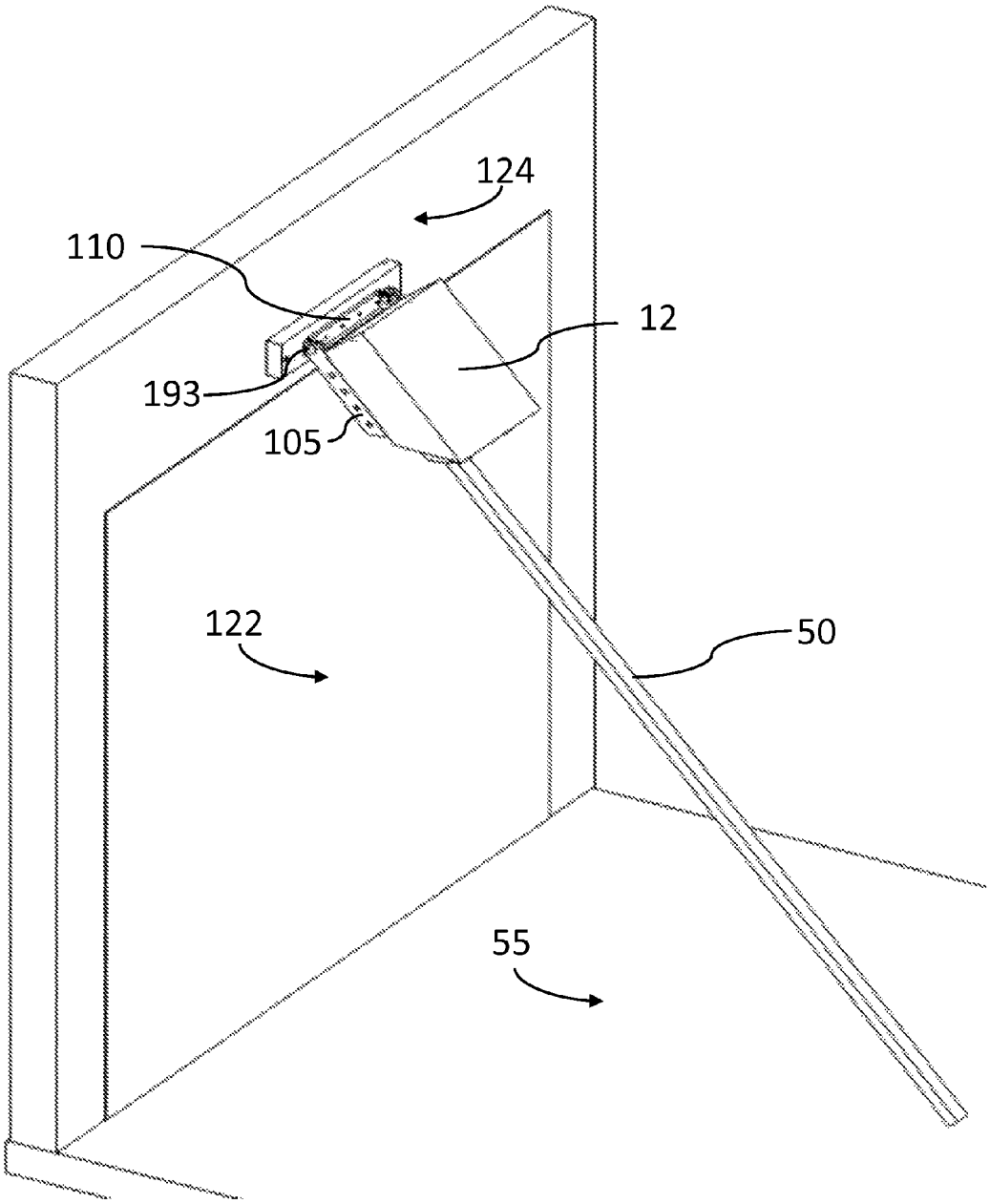
FIG. 13 is a perspective view of the second component of a generic installation geometry for the present invention.

Component 2 of the generic installation geometry is depicted in FIG. 13, in which the drive assembly 77, attached to a rail 50, has been lifted so it can be mated to the hinge bracket 110, with the distal end of the rail 50 resting upon the garage floor 55. With the drive assembly 77 and rail 50 supported by the appropriate means in this position, one of the pair of removable hinge pins 193 may be inserted through the support arm 105 of the novel drive assembly 77 and the hinge bracket 110, and secured with a clevis or cotter pins (not shown) or equivalent fasteners. The other removable hinge pin 193 may be attached in a similar manner on the other side.

Generic Installation Geometry Component 3

Figure 14:
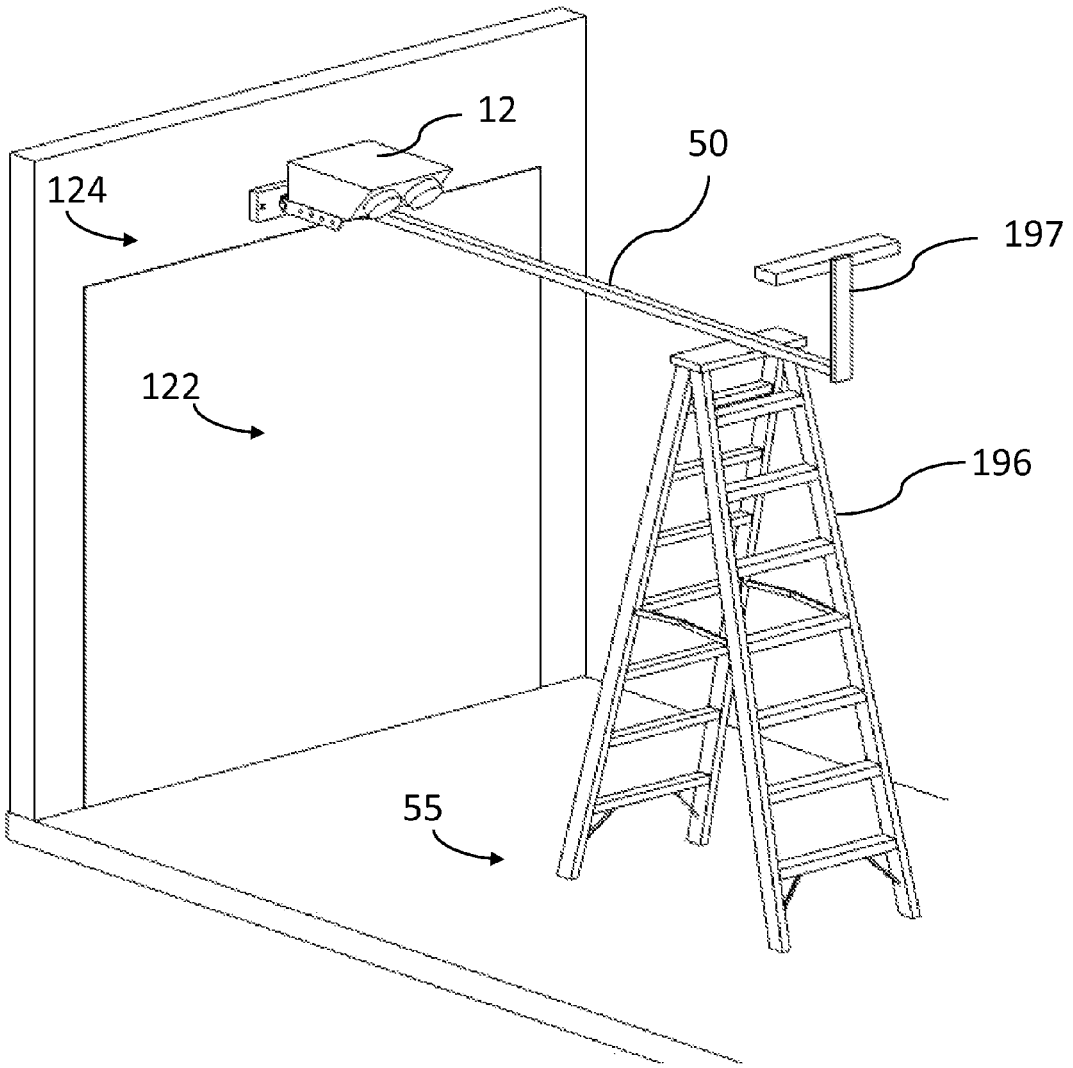
FIG. 14 is a perspective view of the third component of a generic installation geometry for the present invention.

FIG. 14 portrays Component 3 of the generic installation geometry, in which the raised distal end of the rail 50 (with the proximal end of the rail 50 attached to the novel drive assembly 77), supported upon a ladder 196 or other structure, may be attached to the garage ceiling at the correct height using the appropriate means, such as the "T structure" 197. Consistent with the prior art, the distal end of the rail 50 may be attached to a bracket (not shown) on 197 using a removable pin (not shown). This geometry, which allows the entire garage door opener to be installed with a total of only 3 removable pins, also enables a very safe and simple means to remove and reinstall the opener.

Advantages of Installation Process of Present Invention

Since the preferred embodiments of the present invention specifies that the drive assembly hinge pins be removable, after the above installation the assembled rail type garage door opener will be held in place with three removable pins. These units can subsequently be removed for repair or replacement by simply extracting the three pins. After repair, or when replacing with a new unit with the same geometry, the new re-installment can be accomplished easily with the same three pins. While other means may exist to make rail type garage door openers easier to remove and reinstall, there are rarely if ever used, while the present invention includes this capability as an inherent part of the design.

The above example of an installation and reinstallation process is provided to illustrate one easy and efficient approach for installation with the present invention, with the recognition that those who manufacture and sell rail type garage door openers have the responsibility to provide hardware and associated installation guidelines that are as safe as possible.

Having an easy and efficient removal and replacement process for rail type garage door openers has numerous advantages. For example, while there are numerous brand names under which rail type garage door openers are sold, a large majority of them share common components. As such, one of the primary failures of rail type garage door openers is due to the failure of a primary gear fabricated of plastic, which can become stripped due to a combination of usage and lack of lubricant. This part can be obtained for only a few dollars, but the cost of removing, repairing, and replacing the drive assembly by a skilled contractor will usually cost more than a new unit. For this reason, as a rule, drive assemblies that have any malfunction are replaced rather than repaired. Therefore, warranties that cover cost and labor for rail type garage door openers tend to be very expensive, and many units that are recoverable end up in landfills.

The present invention can substantially reduce the cost of warranties for rail type garage door openers, so that many more property owners will obtain them, which will extend the useful lifetime of the units, and encourage the repair rather than the scrapping of units that malfunction.

While it is not the primary benefit of this invention, its configuration does reduce visual clutter, as the geometry of the (now) distal end of the rail type garage door opener is much simplified, an advantage that becomes pronounced in multiple car garages.

Marketability and Comparison of Various Embodiments

A further advantage of the present invention is that can provide the significant benefits described above without requiring inordinate efforts by existing suppliers to introduce it into the marketplace. Makers of garage door openers that wish to make the minimum changes to existing lines must relocate ancillary functions from the "back" (i.e., facing the garage wall) of the drive assembly, design and fabricate mechanical adapters to allow the drive assembly and the distal end of the rail to be mounted as described herein in their new positions, and provide new installation instructions. Makers who choose to introduce new designs with more significant changes that avoid the need for mechanical adapters must also move ancillary functions as required, and modify their chassis designs to support the hinged arrangement provided herein. In both cases, makers will attempt to maintain backward compatibility with existing product lines.

Neither of these two basic approaches is particularly onerous to those skilled in the arts of design and manufacturing, which should allow commercial units conforming to the present invention to be brought to market quickly.

In comparing the various embodiments presented herein, it is useful to first consider the embodiment 200 in FIG. 3 versus embodiment 300 FIG. 5, noting that embodiment 200 is tailored for prior art drive assemblies with two tabs, while embodiment 300 is tailored for prior art drive assemblies with one tab. Neither of these embodiments necessarily requires any changes to prior art drive assemblies; if changes are necessary, they would primarily involve moving ancillary functions away from the "back" of the units (i.e., the side facing the wall). Given the similarities, embodiment 200 may be slightly preferred as the "kit" of parts required for installation is simpler, as is the installation process itself.

The embodiment 500 in FIG. 7 and the embodiment 600 in FIG. 10 can also be compared, with the note that both of them propose that vendors make substantive changes to prior art assemblies. Of these two embodiments, the embodiment in FIG. 10 has two advantages. The first advantage is that in the FIG. 10 embodiment there is virtually no changes to the chassis and packaging associated hardware and electronics within the prior art drive assembly. Referring to FIG. 10, the support arm 105 is merely a reinforced extension of parallel mounting tabs from the prior art, is provided with a set of mounting holes represented by 129 that provide equivalent mounting points to those on the parallel mounting tabs of the prior art. The second advantage is that the FIG. 10 drive assembly can be "flipped over" again, so it reverts to a configuration with the mounting holes 129 on the top of the drive assembly. From a mechanical standpoint, the drive assembly can now be "suspended" in a manner consistent with either the traditional suspension from the garage ceiling, as well as the over the door techniques described in FIG. 3 and FIG. 5.

It should be noted that current installation instructions for rail type garage door openers specify any required "tilt" of the axis of the rail (relative to horizontal) as well as the relative position of the rail versus the articulated garage door, and that such instructions vary as a function of garage door type. As such, in making the second change above, the vendor should consider that the axis of the rail is substantially unchanged versus its current location, as the geometric position of the rail axis is chosen to optimize performance.

This minimalist approach allows garage door suppliers to make units that have the option of being used in either the traditional configuration, or conforming to the present invention. The suppliers would have the option to decide how best to provide this choice. For example, the mechanical adapters and new installation procedures could be marketed as a separate kit, which would allow consumers to retrofit existing installations. Suppliers could continue to make the traditional openers, giving consumers the option to purchase the openers with or without the kit.

In a variant of the above approach, suppliers would make minor changes and or additions to existing hardware to improve their application to the present invention, while still retaining backward compatibility with previous hardware. Finally, there is an option to diverge from previous designs entirely, and only provide units that support the present invention. For example, mounting brackets, for wall mounting, could be incorporated into the "back" of the motor assembly, i.e., the side remote from the side from which the rail extends. None of the foregoing options is particularly onerous As such, the preferred embodiments provided herein illustrate robust design approaches, with the recognition that the choice of which alternative to pursue with regard to implementing this invention should not a major driver in cost, time-to-market, mechanical strength and safety, and so on. Whereby, it is expected that the best embodiment chosen by a particular supplier will be based upon the configuration of their existing hardware.

Present Invention is not a Trivial Combination

Because the present invention refers to the prior art for rail type garage door openers, it is critical to place this reference in perspective. The need to do so is particularly appropriate in light of a judgment by the U.S. Supreme Court in 2007 concerning the issue of obviousness as applied to patent claims, that particularly emphasized "the need for caution in granting a patent based on the combination of elements found in the prior art" (KSR Int'l Co. v. Teleflex, Inc., 550 U.S. 398 (2007)).

In this light, it should be clarified that prior art elements for garage door openers cited herein may be characterized as having a "ceiling mounted drive assembly", which has an attached rail with a "wall mounted distal end". This phrasing underscores the fact that as a component of prior art garage door openers of the rail type, prior art drive assemblies are designed for the sole purpose of suspending them from ceiling mounts, and cannot be mounted to the wall without changes and special accommodations. Beyond a uniform need for mechanical adapters, most, if not all, prior art drive assemblies have ancillary functions, such as lighting, wiring, and controls, which would be rendered useless even with special mounting accommodations, since they would be on the "back" of the drive assembly (i.e., facing the wall. The same distinction applies to the "wall mounted distal end" of the prior art rail, as which can be characterized in the present invention as a as a "ceiling mounted distal end"; there is nothing in the prior art that contemplates it in anything but the prior art embodiment.

The conclusion to be drawn from the above is that the elements in the present invention are not the same as those in the prior art. As such, there is no foundation to consider the present invention as merely a combination of prior art elements, since the prior art elements cannot be simply combined to yield the present invention.

Rather, from an objective standpoint, the present invention embodies a novel architecture for a rail type garage door opener that is fundamentally different from the prior art, and provides advantages that a mere rearrangement could never do. The novel architecture of the present invention is not a trivial rearrangement that delivers the same results as the prior art, but a fundamentally new design that provides significant and unforeseen benefits. In doing so, it corrects a fundamental flaw deriving from the first garage door opener of the rail type, a flaw that has been perpetuated through hundreds of incremental inventions over almost an entire century.

No Teaching, Suggestion, or Motivation in the Prior Art

Even assuming that somehow the judgment is made that the elements in the prior art and present invention described above should be deemed as "identical", there is in fact no "teaching, suggestion, or motivation in the prior art, either explicit or implicit, that would have led one of ordinary skill to modify the prior art reference or to combine prior art reference teachings to arrive at the claimed invention" (Examples of Basic Requirements of a Prima Facie Case of Obviousness [R-9] 2143, Laws, Regulations, Policies & Procedures, U.S. Patent and Trademark Office).

Inventive Contribution in Identifying a Problem in a New Revelatory Way

It is true that the disclosure of the above invention may lead some to conclude, after the fact, that it is obvious in some form or another, but this conclusion is clearly a manifestations of "improper hindsight", a pitfall that the U.S.P.T.O (U.S. Patent and Trademark Office) has taken great pains to prevent. In a very pertinent ruling, the Federal Circuit panel in Mintz (Mintz v. Dietz & Watson Inc., 679 F. 3d. 1372, 1377 (Fed. Cir. 2012), consisting of Chief Judge Randall Rader and Judges Pauline Newman and Timothy Dyk, noted that, when relying on common sense, one must avoid "using the invention to define the problem that the invention solves. Often the inventive contribution lies in defining the problem in a new revelatory way." Thus, when performing an obviousness analysis based on common sense, a significant factor in the analysis is the identification of the problem to be solved by one of ordinary skill in the art at the time the invention was made. It appears quite clear that the identification of the safety issue inherent in the unnecessary suspension of heavy masses over spaces occupied by human beings is a unique contribution of this invention, one which has no precedent in the prior art.

Common Sense Basis for Unobviousness

Recent court judgments, echoed in the Laws, Regulations, Policies and Procedures of the U.S.P.T.O., emphasize that the guidelines regarding an assessment of obviousness that are provided in this document are not be interpreted per se, and should not preclude the use of "common sense". Applying these principles to the present invention, we note that electric garage door openers were invented almost 90 years ago, and these devices have been for many decades ubiquitous throughout the world, and constitute a market of about $2.0 billion per year, and that the makers of these products have been diligent in employing skilled personnel to improve their products and increase their market share.

If we accept the premise that the present invention provides great advantages versus the prior art via a modest redesign, and perhaps even a reduction in cost, and that these advantages include enhancing safety for perhaps hundreds of millions of people, and thereby has the potential for great commercial gain, it leads to a very "common sense" question: if the present invention is "obvious", why hasn't it been discovered and disclosed during almost 90 years?

Certainly, in this case, the reason cannot be that it is only recent technological advances have made the present invention possible; there appears to be no reason based upon technological maturity why the present invention could not have been incorporated in this very first invention in this category, which was disclosed in the 1920's. It seems more likely that due to an oversight at that time, the prior art architecture for traditional rail type garage door openers was established, and "grandfathered into" all subsequent improvements since.

CONCLUSION

In conclusion, the fundamental change proposed by the present invention may be compared to the introduction of a lever with a mechanical advantage in an era where the prior art had been confined to the use of "see-saws" for a century. A see-saw is a limited form of lever where the fulcrum is in the middle, and is useful in many ways. However, moving the fulcrum clearly provides novel and significant advantages. In the above example, a lever with a mechanical advantage would qualify as a legitimate invention in spite of the fact that the constituent parts (a fulcrum and a bar) are the same as a "see-saw".

The present invention, while certainly not of the historical import of the invention of the lever, has a stronger claim of non-obviousness. As pointed out previously, while the novel design and architecture of the present invention uses building blocks that are similar to the prior art, the building blocks required for the present invention are not, and cannot be, the same as in the prior art. If there were, it could only occur if the disclosures herein were not novel, which could only occur if a number of specific means that differ from the prior art had already been provided to reduce the present invention to practice.

When considered in the above context, the ease of installation and the paramount safety advantages of the present invention, as well as the relatively modest means needed to acquire them, should make it clear that the present invention is not only novel, useful, and non-obvious, but is sorely needed.

I claim:

1. A door opener mechanism for a garage comprising:

a drive assembly containing a drive motor and containing supporting mechanical and electronic components;

a rail having a distal end and a proximal end, said proximal end fixed to said drive assembly, and where said rail is in a horizontal plane;

a trolley, mechanically coupled to an overhead door, that is driven along said rail to open and close said overhead door;

said drive assembly secured with a pivotable mount on the wall above a door opening that allows said drive assembly to rotate around a horizontal axis during installation, removal, and re-installation of said door opener mechanism;

wherein said pivotable mount for said drive assembly is hinged in a manner that allows said drive assembly to have a rotation axis that is parallel to a top of said door opening and located under said drive assembly, whereby said door opener can be installed, removed, and reinstalled with only three removable pins; and wherein said drive assembly is comprised of an inverted drive assembly chassis, such that said rail is below said drive assembly, wherein said drive assembly has an integral pair of support arms essentially in the same horizontal plane as said rail, wherein with the use of a pair of the said three removable pins said support arms are mounted to a hinge bracket that is attached to a wall mounted support block, whereby said hinge bracket maintains correct geometry for said rotation axis to allow for rotation of said drive assembly.

2. The mechanism of claim 1, wherein said pivotable mount, installed over said door opening, permits said drive assembly to be secured to said pivotable mount by a pair of the said three removable pins while said distal end of said rail of said drive assembly is resting upon a floor, such that said distal end of rail can be to lifted the correct elevation above said floor, and attached to a means for supporting said distal end from a ceiling.

3. The mechanism of claim 1, wherein said drive assembly is further comprised with an AC power outlet and a DC power outlet, wherein said AC power outlet and said DC power outlet are controlled by said drive assembly, whereby switched power from said AC power outlet and said DC power outlet can be utilized for satellite illumination to supplement illumination provided by said drive assembly.

4. The mechanism of claim 1, wherein said inverted drive assembly chassis is said an essentially single plane chassis, wherein said support arms are an integral component of said single plane chassis, whereby said support arms are also an integral part of said pivotable mount.

5. A door opener mechanism for a garage comprising:

a drive assembly containing a drive motor and containing supporting mechanical and electronic components;

a rail having a distal end and a proximal end, said proximal end fixed to said drive assembly, and where said rail is in a horizontal plane;

a trolley, mechanically coupled to an overhead door, that is driven along said rail to open and close said overhead door;

said drive assembly secured with a pivotable mount on the wall above a door opening that allows said drive assembly to rotate around a horizontal axis during installation, removal, and re-installation of said door opener mechanism;

wherein said pivotable mount for said drive assembly is hinged in a manner that allows said drive assembly to have a rotation axis that is parallel to a top of said door opening, whereby said door opener can be installed, removed, and reinstalled with only three removable pins; and wherein said drive assembly is comprised of an drive assembly chassis, wherein said drive assembly chassis has a pair of drive assembly hinge elements that are integral to said drive assembly, wherein said drive assembly hinge elements are mounted with a pair of said three removable pins to a support adapter that is attached to a wall mounted support block, whereby said support adapter maintains correct geometry for said rotation axis to allow for rotation of said drive assembly.

6. The mechanism of claim 5, wherein said pivotable mount, installed over said door opening, permits said drive assembly to be secured to said pivotable mount by a pair of the said three removable pins while said distal end of said rail of said drive assembly is resting upon a floor, such that said distal end of rail can be to lifted the correct elevation above said floor, and attached to a means for supporting said distal end from a ceiling.

7. The mechanism of claim 5, wherein said drive assembly is further comprised with an AC power outlet and a DC power outlet, wherein said AC power outlet and said DC power outlet are controlled by said drive assembly, whereby switched power from said AC power outlet and said DC power outlet can be utilized for satellite illumination to supplement illumination provided by said drive assembly.

8. A door opener mechanism for a garage comprising:

a drive assembly containing a drive motor and containing supporting mechanical and electronic components;

a rail having a distal end and a proximal end, said proximal end fixed to said drive assembly, and where said rail is in a horizontal plane;

a trolley, mechanically coupled to an overhead door, that is driven along said rail to open and close said overhead door;

said drive assembly secured with a pivotable mount on the wall above a door opening that allows said drive assembly to rotate around a horizontal axis during installation, removal, and re-installation of said door opener mechanism;

wherein said pivotable mount for said drive assembly is hinged in a manner that allows said drive assembly to have a rotation axis that is parallel to top of said door opening and over said drive assembly, whereby said door opener can be installed, removed, and reinstalled with three removable pins; and wherein said drive assembly has a pair of parallel mounting tabs on a top of said drive assembly, wherein said pivotable mount comprises a pair of support adapters that are each fastened to a respective one of said mounting tabs, said support adapters are mounted with a pair of said three removable pins to a hinge bracket, said hinge bracket is attached to a wall mounted support block, whereby said hinge bracket maintains the correct geometry of said rotation axis to allow for rotation of said drive assembly.

9. The mechanism of claim 8, wherein said pivotable mount, installed over said door opening, permits said drive assembly to be secured to said pivotable mount by a pair of the said three removable pins while said distal end of said rail of said drive assembly is resting upon a floor, such that said distal end of rail can be to lifted the correct elevation above said floor, and attached to a means for supporting said distal end from a ceiling.

10. The mechanism of claim 8, wherein said drive assembly is further comprised with an AC power outlet and a DC power outlet, wherein said AC power outlet and said DC power outlet are controlled by said drive assembly, whereby switched power from said AC power outlet and said DC power outlet can be utilized for satellite illumination to supplement illumination provided by said drive assembly.

* * * * *